US011249408B2

(12) United States Patent
Tsuda et al.

(10) Patent No.: US 11,249,408 B2
(45) Date of Patent: Feb. 15, 2022

(54) TONER

(71) Applicant: CANON KABUSHIKI KAISHA, Tokyo (JP)

(72) Inventors: Shohei Tsuda, Mishima (JP); Tsuneyoshi Tominaga, Suntou-gun (JP); Masatake Tanaka, Yokohama (JP); Taiji Katsura, Suntou-gun (JP); Masamichi Sato, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/911,929

(22) Filed: Jun. 25, 2020

(65) Prior Publication Data

US 2021/0003932 A1 Jan. 7, 2021

(30) Foreign Application Priority Data

Jul. 2, 2019 (JP) ..... JP2019-123914

(51) Int. Cl.
*G03G 9/08* (2006.01)
*G03G 9/097* (2006.01)

(52) U.S. Cl.
CPC ..... *G03G 9/0819* (2013.01); *G03G 9/0815* (2013.01); *G03G 9/0821* (2013.01); *G03G 9/0823* (2013.01); *G03G 9/09733* (2013.01)

(58) Field of Classification Search
CPC .. G03G 9/0819; G03G 9/0821; G03G 9/0823; G03G 9/09733
USPC ..... 430/111.41, 108.1
See application file for complete search history.

(56) References Cited

U.S. PATENT DOCUMENTS

| | | | |
|---|---|---|---|
| 7,833,685 | B2 | 11/2010 | Tanaka et al. |
| 7,858,282 | B2 | 12/2010 | Ayaki et al. |
| 8,372,573 | B2 | 2/2013 | Ayaki et al. |
| 8,377,616 | B2 | 2/2013 | Tani et al. |
| 8,383,313 | B2 | 2/2013 | Ayaki et al. |
| 8,551,680 | B2 | 10/2013 | Ayaki et al. |
| 8,628,899 | B2 | 1/2014 | Kawamura et al. |
| 8,815,484 | B2 | 8/2014 | Tanaka et al. |
| 9,158,216 | B2 | 10/2015 | Shimano et al. |
| 9,377,705 | B2 | 6/2016 | Shimano et al. |
| 9,383,668 | B2 | 7/2016 | Noji et al. |
| 9,423,708 | B2 | 8/2016 | Tominaga et al. |
| 9,470,993 | B2 | 10/2016 | Nishikawa et al. |
| 9,500,972 | B2 | 11/2016 | Tanaka et al. |
| 9,575,424 | B2 | 2/2017 | Nakagawa et al. |
| 9,575,425 | B2 | 2/2017 | Naka et al. |
| 9,588,450 | B2 | 3/2017 | Tsuda et al. |
| 9,599,919 | B2 | 3/2017 | Isono et al. |
| 9,606,462 | B2 | 3/2017 | Nomura et al. |
| 9,632,441 | B2 | 4/2017 | Abe et al. |
| 9,658,546 | B2 | 5/2017 | Tanaka et al. |
| 9,658,549 | B2 | 5/2017 | Tanaka et al. |
| 9,715,188 | B2 | 7/2017 | Terauchi et al. |
| 9,720,340 | B2 | 8/2017 | Tominaga et al. |
| 9,733,583 | B2 | 8/2017 | Kuroki et al. |
| 9,733,584 | B2 | 8/2017 | Masumoto et al. |
| 9,772,570 | B2 | 9/2017 | Tsuda et al. |
| 9,778,583 | B2 | 10/2017 | Terauchi et al. |
| 9,785,071 | B2 | 10/2017 | Shimano et al. |
| 9,785,077 | B2 | 10/2017 | Abe et al. |
| 9,829,816 | B2 | 11/2017 | Tanaka et al. |
| 9,829,820 | B2 | 11/2017 | Masumoto et al. |
| 9,835,964 | B2 | 12/2017 | Yoshida et al. |
| 9,857,707 | B2 | 1/2018 | Tsuda et al. |
| 9,897,932 | B2 | 2/2018 | Hotta et al. |
| 9,904,193 | B2 | 2/2018 | Nakagawa et al. |
| 9,904,195 | B2 | 2/2018 | Matsui et al. |
| 9,904,198 | B2 | 2/2018 | Omori et al. |
| 9,921,501 | B2 | 3/2018 | Mochizuki et al. |
| 9,958,801 | B2 | 5/2018 | Tanaka et al. |
| 10,012,919 | B2 | 7/2018 | Matsui et al. |
| 10,054,866 | B2 | 8/2018 | Tanaka et al. |
| 10,114,303 | B2 | 10/2018 | Katsura et al. |
| 10,156,800 | B2 | 12/2018 | Tsuda et al. |
| 10,197,934 | B2 | 2/2019 | Matsui et al. |
| 10,303,074 | B2 | 5/2019 | Yamawaki et al. |
| 10,429,757 | B2 | 10/2019 | Yoshida et al. |
| 10,503,090 | B2 | 12/2019 | Tominaga et al. |
| 10,545,422 | B2 | 1/2020 | Yamawaki et al. |
| 10,578,990 | B2 | 3/2020 | Tsuda et al. |
| 10,635,011 | B2 | 4/2020 | Umeda et al. |
| 10,678,155 | B2 | 6/2020 | Terui et al. |
| 10,747,133 | B2 | 8/2020 | Yagi et al. |
| 10,782,623 | B2 | 9/2020 | Yoshiba et al. |
| 10,809,639 | B2 | 10/2020 | Yamawaki et al. |

(Continued)

FOREIGN PATENT DOCUMENTS

| | | |
|---|---|---|
| JP | 2009-003083 | 1/2009 |
| JP | 2010-176068 | 8/2010 |

(Continued)

OTHER PUBLICATIONS

U.S. Appl. No. 17/145,896, Ai Suzuki, filed Jan. 11, 2021.

(Continued)

*Primary Examiner* — Mark A Chapman
(74) *Attorney, Agent, or Firm* — Venable LLP

(57) ABSTRACT

A toner including a toner particle including a binder resin, wherein fine particles A and B are present on a surface of the toner particle; the fine particles A are a fatty acid metal salt; the fine particles B have a specific volume resistivity; an average theoretical surface area of the toner particle, an amount of the fine particles A, and a coverage ratio of the toner particle surface by the fine particles A satisfy a specific relationship; the amount of the fine particles B is in a specific range; and a proportion F of an area occupied by a part of the fine particles B embedded in a surface vicinity region of the toner in a total area occupied by the fine particles B present in a cross section of one particle of the toner is 50% by area or more.

11 Claims, No Drawings

(56) References Cited

U.S. PATENT DOCUMENTS

| | | | |
|---|---|---|---|
| 10,845,721 | B2 | 11/2020 | Tanaka et al. |
| 10,942,465 | B2 | 3/2021 | Kototani et al. |
| 10,942,466 | B2 | 3/2021 | Tominaga et al. |
| 10,976,678 | B2 | 4/2021 | Yamawaki et al. |
| 10,976,679 | B2 | 4/2021 | Tanaka et al. |
| 11,003,104 | B2 | 5/2021 | Katsura et al. |
| 11,003,105 | B2 | 5/2021 | Sato et al. |
| 2010/0035171 | A1 | 2/2010 | Watanabe et al. |
| 2014/0356779 | A1 | 12/2014 | Hasegawa et al. |
| 2015/0125790 | A1 | 5/2015 | Hotta et al. |
| 2015/0248072 | A1 | 9/2015 | Katsuta et al. |
| 2020/0166861 | A1 | 5/2020 | Uratani et al. |
| 2020/0183295 | A1* | 6/2020 | Kanno ..... G03G 9/08755 |
| 2020/0209776 | A1 | 7/2020 | Kototani et al. |
| 2020/0292955 | A1 | 9/2020 | Matsunaga et al. |

FOREIGN PATENT DOCUMENTS

| | | |
|---|---|---|
| JP | 2013-164477 | 8/2013 |
| JP | 2017-116849 | 6/2017 |

OTHER PUBLICATIONS

U.S. Appl. No. 17/329,740, Shintaro Kawaguchi, filed May 25, 2021.

U.S. Appl. No. 17/348,053, Taiji Katsura, filed Jun. 15, 2021.

* cited by examiner

TONER

BACKGROUND OF THE INVENTION

Field of the Invention

The present invention relates to a toner to be used in an image forming method such as an electrophotographic method.

Description of the Related Art

In recent years, a demand has been created for printers having longer life and smaller size, and further improvement in various performances of toners carried in the printers has been required. For example, from the viewpoint of prolonging the service life, it is required to further improve the long-term durability, and from the viewpoint of miniaturization, it is required to minimize the volume of each unit.

Conventionally, from the viewpoint of improving long-term durability, high durability photosensitive members such as amorphous silicon photosensitive members and organic photosensitive members having a surface protective layer made of a curable resin have been used to improve the durability of image forming apparatuses. However, it is known that the higher the durability of the photosensitive member, the greater the effect of the deterioration of the surface state of the photosensitive member on the image quality.

One of the factors causing the surface change of the photosensitive member that affects the image quality is nitrogen oxides present in the atmosphere. Nitrogen oxides are gases contained in, for example, exhaust gas of automobiles, and exemplify air pollutants that have recently become a problem.

It is known that nitrogen oxides dissolve in water to form an aqueous solution of an electrolyte such as nitric acid. Therefore, where an image forming apparatus is allowed to stand overnight without being used in a high-temperature and high-humidity environment where water easily adheres to the photosensitive member surface, the nitrogen oxides dissolve in the water adhering to the photosensitive member surface to form an aqueous electrolyte solution. As a result, in some cases, the electric resistance of the photosensitive member surface is reduced, formation of a clear electrostatic latent image is inhibited, and image quality is deteriorated (hereinafter referred to as image smearing).

Meanwhile, from the viewpoint of miniaturization, attempts have been made to reduce the size of various units. For example, it is desirable to miniaturize a waste toner container for collecting untransferred toner on the photosensitive drum, but a retransfer is an obstacle for such miniaturization.

When a full-color image is formed using an intermediate transfer member in an electrophotographic image forming apparatus, toners of a plurality of colors are transferred onto the intermediate transfer member. At this time, a phenomenon may occur in which the toner transferred on the intermediate transfer member on the upstream side moves from the intermediate transfer member to the electrostatic image bearing member such as a photosensitive member when transferring the color on the downstream side. This is the retransfer.

This phenomenon is more likely to occur in a toner charged up due to durable use, and is more likely to occur in a low-temperature and low-humidity environment. Since the retransferred toner is stored as waste toner in a cleaning device, the size of the waste toner container cannot be reduced if the amount of the retransferred toner is large. In addition, the occurrence of the retransfer may lead to a decrease in image quality such as a decrease in image density or the occurrence of density unevenness in the image.

As described above, in order to achieve a longer life and smaller size of the printer, it is desired, for example, to achieve both the suppression of image smearing and the retransfer.

A technique of preventing the attachment of nitrogen oxides to a photosensitive member surface and removing nitrogen oxides with an additive has been proposed for suppressing the image smearing. For example, a well-known means for preventing the attachment of nitrogen oxides involves adding a fatty acid metal salt as an external additive so as to cover the electrostatic latent image bearing member with a fatty acid metal salt thereby suppressing the attachment of nitrogen oxides.

Japanese Patent Application Publication No. 2017-116849 proposes a toner in which the attachment state of a fatty acid metal salt on the toner is controlled.

Further, Japanese Patent Application Publication No. 2013-164477 proposes to achieve both charging stability and cleaning property by externally adding silica, titania, and a fatty acid metal salt to a toner particle in multiple stages to control the rate of adhesion of the fatty acid metal salt to the toner.

Furthermore, Japanese Patent Application Publication No. 2010-176068 proposes to achieve both charging optimization and cleaning property by adding a composite fine particle of titania and silica and a fatty acid metal salt.

Japanese Patent Application Publication No. 2009-003083 proposes to improve charging stability by controlling the volume resistivity and adding, as an external additive, titanium oxide treated with a fatty acid metal salt or the like.

SUMMARY OF THE INVENTION

However, it has been found that, for example, in the toner disclosed in Japanese Patent Application Publication No. 2017-116849, although a certain effect on image smearing is confirmed, there is still room for study from the viewpoint of reducing also the retransfer by suppressing charge-up through durable use.

Thus, it has been found that there is still room for improvement in relation to the retransfer in a long-term use in a low-temperature and low-humidity environment and the image smearing in a long-term use in a high-temperature and high-humidity environment in the toners of the abovementioned patent documents.

The present invention provides a toner which solves the abovementioned problems. That is, the present invention provides a toner capable of retaining a sharp charge distribution and a member coating effect of a fatty acid metal salt through durable use, and also capable of maintaining the suppression of retransfer and the suppression of image smearing.

The present inventors have found that the abovementioned problems can be solved by causing a fatty acid metal salt, which is necessary for suppressing the image smearing, to be present at a specific coverage ratio in a toner particle in which fine particles having a controlled volume resistivity are present vicinity of the toner particle surface.

A toner comprising a toner particle including a binder resin, wherein fine particles A and fine particles B are present on a surface of the toner particle;

the fine particles A are fatty acid metal salt;

the fine particles B have a volume resistivity of from 5.0×10 Ωm to 1.0×10 Ωm;

when, an average theoretical surface area obtained from a number average particle diameter, particle size distribution and true density of the toner particle measured by a Coulter counter is denoted by C ($m^2/g$), an amount of the fine particles A with respect to 100 parts by mass of the toner particle is denoted by D (parts by mass), and a coverage ratio of a surface of the toner particle by the fine particles A is denoted by E (%), formulas (1) and (2) below are satisfied:

$$0.03 \leq D/C \leq 1.50 \quad (1),$$

$$E/(D/C) \leq 50.0 \quad (2);$$

an amount of the fine particles B is from 0.10 parts by mass to 3.00 parts by mass based on 100 parts by mass of the toner particle; and in an observation of a cross-section of the toner by a transmission electron microscope, a proportion F of an area occupied by a part of the fine particles B in which a length of a portion of each of the fine particles B in contact with the toner particle is 50% or more of a peripheral length of each of the fine particles B, and which presents in a surface vicinity region from a contour of a cross section of one particle of the toner to 30 nm inside toward a centroid of the cross section, in a total area occupied by the fine particles B present in the cross section of one particle of the toner, is 50% by area or more.

The present invention can provide a toner capable of retaining a sharp charge distribution and a member coating effect of a fatty acid metal salt through durable use, and also capable of maintaining the suppression of retransfer and the suppression of image smearing.

Further features of the present invention will become apparent from the following description of exemplary embodiments.

DESCRIPTION OF THE EMBODIMENTS

Unless otherwise specified, descriptions of numerical ranges such as "from XX to YY" or "XX to YY" in the present invention include the numbers at the upper and lower limits of the range.

As described above, in order to suppress the image smearing, it is important to prevent nitrogen oxides from being attached to the photosensitive member surface, and coating the photosensitive member surface with a fatty acid metal salt is known to be effective in this respect.

Meanwhile, it was found that when the rotation speed of a developing roller and the stirring speed of a developer are raised due to an increase in the speed of the printer, under certain process conditions, the conventional toner including a fatty acid metal salt cannot retain the effect of coating the photosensitive member surface with the fatty acid metal salt over along period of use. The reason therefor is considered hereinbelow.

In the conventional toner, an external additive such as silica or titania particles is also added in addition to the fatty acid metal salt. The fatty acid metal salt is a malleable material that is easily deformed, and is spread on the surface of the toner particles by receiving the shear. At this time, the fatty acid metal salt collects silica and titania, that is, the external additives such as silica and titania are easily detached from the toner particle surface, so that the charging becomes non-uniform and image defects such as fogging occur.

In addition, it has been found that the conventional toner including a fatty acid metal salt has a problem that the retransfer is likely to occur due to an increase in the speed of the printer. The reason therefor is considered hereinbelow.

It is considered that in the case of a negative-charging toner, the toner transferred (primary transfer) to the intermediate transfer member in an image forming unit on the upstream side is discharged when passing through a potential portion of the non-image portion of the photosensitive member in an image forming unit on the downstream side, and the polarity is reversed from minus to plus, thereby causing the retransfer of the toner on the photosensitive member.

In particular, it is considered that when an image is formed by a toner layered in multiple layers on the intermediate transfer member, the polarity of the toner of the lower layer is more likely to be reversed, and the toner of the upper layer may be excessively charged (charge-up), so that the retransfer is likely to occur. In particular, in a low-temperature and low-humidity environment, the polarity reversal of the toner becomes excessive, and the retransfer is more likely to occur.

As described above, assuming a higher speed and a smaller size of printers in the future, it is important to achieve the following two results in a toner using a fatty acid metal salt to suppress the image smearing. Thus, it is important (1) to improve the retention of the coating film effect of the fatty acid metal salt on the photosensitive member surface and (2) to suppress the occurrence of retransfer due to the use of the fatty acid metal salt.

First, let us consider how to retain the coating film effect of the fatty acid metal salt on the photosensitive member surface.

As described above, since the fatty acid metal salt is highly malleable, when the rubbing strength increases, the metal salt is easily stretched and is likely to collect fine particles such as silica and titania. In addition, the stretched fatty acid metal salt hardly migrates to the photosensitive member surface due to an increase in the adhesive force to the toner particle surface, and cannot sufficiently cover the surface of the photosensitive member. Therefore, it is important that the fatty acid metal salt particles be attached as they are, without stretching, to the surface of the toner particle.

Next, the present inventors have considered a method for suppressing the retransfer due to toner charge-up. It is necessary for the toner to have the optimal charge amount, but it has been considered to be important to ensure a structure that leaks excessive charge in order to maintain the optimal charge quantity and suppress the charge-up over long-term use. The use of fine particles with controlled volume resistivity has been considered for this purpose.

However, it was found that where fine particles with controlled volume resistivity, such as an external additive, are arranged on the outermost surface of the toner, a charge leakage is likely to occur and the optimal charge amount is difficult to maintain. Therefore, by arranging a specific amount of fine particles with controlled volume resistivity vicinity of the surface of the toner particles, it is possible to suppress the charge-up while maintaining the optimal charge amount, and the retransfer can be suppressed even after long-term use.

Furthermore, by disposing fine particles with controlled volume resistivity vicinity of the surface of the toner particle and disposing the fatty acid metal salt in the form of particles, without deagglomerating or stretching, on the toner surface it is possible to resolve the problems of image smearing and retransfer. It is considered that with such a configuration, when the fatty acid metal salt migrates to the photosensitive member surface, since some fine particles with controlled volume resistivity are contained therein, the image smearing can be greatly improved.

The present inventors presume that this is because some fine particles with controlled volume resistivity are contained in the migrating fatty acid metal salt to form a composite, thereby significantly improving slidability on the photosensitive member surface and enabling uniform coating of the photosensitive member surface.

It has been found that with such a toner, the retransfer can be suppressed even in long-term durable use in a low-temperature and low-humidity environment, and the image smearing can be significantly suppressed in a high-temperature and high-humidity environment. The present invention has been created based on this finding.

Specifically, provided is a toner including a toner particle including a binder resin, wherein fine particles A and fine particles B are present on a surface of the toner particle;

the fine particles A are formed of a fatty acid metal salt;

the fine particles B have a volume resistivity of from $5.0\times10$ Ωm to $1.0\times10^8$ Ωm;

where an average theoretical surface area obtained from a number average particle diameter, particle size distribution and true density of the toner particle measured by a Coulter counter is denoted by C ($m^2/g$), an amount of the fine particles A with respect to 100 parts by mass of the toner particle is denoted by D (parts by mass), and a coverage ratio of a surface of the toner particle by the fine particles A is denoted by E (%), formulas (1) and (2) below are satisfied;

an amount of the fine particles B is from 0.10 parts by mass to 3.00 parts by mass based on 100 parts by mass of the toner particle; and in an observation of a cross-section of the toner by a transmission electron microscope, a proportion F of an area occupied by a part of the fine particles B in which a length of a portion of each of the fine particles B in contact with the toner particle is 50% or more of a peripheral length of each of the fine particles B, and which presents in a surface vicinity region from a contour of a cross section of one particle of the toner to 30 nm inside toward a centroid of the cross section, in a total area occupied by the fine particles B present in the cross section of one particle of the toner, is 50% by area or more:

$$0.03\leq D/C\leq 1.50 \quad (1)$$

$$E/(D/C)\leq 50.0 \quad (2).$$

It is important that the volume resistivity of the fine particle B be from $5.0\times10$ Ωm to $1.0\times10^8$ Ωm. When the volume resistivity is less than $5.0\times10$ Ωm, it is difficult for the toner to maintain an appropriate charged power, and the image density tends to be reduced. Where the volume resistivity is larger than $1.0\times10^8$ Ωm, it is difficult for the charge to leak at the time of charge-up, and the retransfer is likely to occur.

The volume resistivity of the fine particle B is preferably $1.0\times10^2$ Ωm to $5.0\times10^7$ Ωm, and more preferably $1.0\times10^4$ Ωm to $5.0\times10^7$ Ωm.

Furthermore, a composite oxide fine particle using two or more kinds of metals can also be used, and a fine particle of one kind or fine particles of two or more kinds selected by arbitrarily combining particles from a group of these fine particles can also be used.

The volume resistivity can be controlled by a calcination temperature and the amount of a surface treatment agent when producing titanium oxide.

It is important that the amount of the fine particles Bin the toner be from 0.10 parts by mass to 3.00 parts by mass with respect to 100 parts by mass of the toner particle in order to suppress the retransfer satisfactorily through a long-term use. Where the amount is less than 0.10 parts by mass, it is difficult to leak the charge at the time of charge-up, and the retransfer easily occurs, and where the amount exceeds 3.00 parts by mass, it is difficult for the toner to maintain an adequate charged power, and the image density tends to decrease.

The amount of the fine particles B in the toner is preferably from 0.30 parts by mass to 2.50 parts by mass, and more preferably from 0.50 parts by mass to 2.50 parts by mass, based on 100 parts by mass of the toner particle.

In a cross-sectional observation of the toner by a transmission electron microscope TEM, a proportion F of an area occupied by a part of the fine particles B in which a length of a portion of each of the fine particles B in contact with the toner particle is 50% or more of a peripheral length of each of the fine particles B, and which presents in a surface vicinity region from a contour of a cross section of one particle of the toner to 30 nm inside toward a centroid of the cross section, in a total area occupied by the fine particles B present in the cross section of one particle of the toner, is 50% by area or more. Within this range, the retransfer and image smearing can be suppressed.

The ratio F being within the above range indicates that most of the fine particles B are embedded in the toner particle and are present near the surface of the toner particle. With such a structure, the charge can be leaked and the optimum charge can be maintained even in a long-term use, so that the retransfer can be easily suppressed.

Where F is less than 50% by area, many fine particles B are not embedded in the toner particle. Therefore, in a long-term use, the fine particles B are detached from the toner or can be more easily collected when the fatty acid metal salt, which is in the form of fine particles A, migrates to the photosensitive member surface. As a result, the toner is likely to be charged-up, and the retransfer is likely to occur.

The proportion F is preferably 60% by area or more, and more preferably 70% by area or more. Meanwhile, the upper limit is not particularly limited, but is preferably 100% by area or less. The proportion F can be controlled by changing the production conditions when the fine particles B are added to the toner particles, the glass transition temperature Tg (° C.) of the toner particle, and the number average particle diameter of the primary particles of the fine particles B.

The number average particle diameter of the primary particles of the fine particles B is preferably from 5 nm to 50 nm, so that the particles could function as a leak site during charge-up. More preferably, the number average particle diameter is from 5 nm to 25 nm.

It is preferable that the fine particles C be present on the toner particle surface. The fine particles C are preferably silica fine particles. The number average particle diameter of the primary particles of the fine particles C is preferably from 5 nm to 50 nm, and more preferably from 5 nm to 30 nm.

Silica fine particles having a particle diameter of from 5 nm to 50 nm are easily aggregated electrostatically and are difficult to deagglomerate. However, when the fine particles B are present on the toner particle surface, the electrostatic aggregation of the fine silica particles is moderated, and the dispersibility of the fine silica particles on the toner particle surface is easily improved. Therefore, by externally adding the external additive C, the charge distribution on the toner particle surface can be easily made uniform, and the charge distribution can be sharpened. As a result, the image density uniformity is improved.

From the viewpoint of image density uniformity, it is preferable that in a cross-sectional observation of the toner by a transmission electron microscope TEM, a proportion of an area occupied by a part of the fine particles C in which a length of a portion of each of the fine particles C in contact with the toner particle is 50% or more of a peripheral length of each of the fine particles C, and which presents in a surface vicinity region from a contour of a cross section of one particle of the toner to 30 nm inside toward a centroid of the cross section, in a total area occupied by the fine particles C present in the cross section of one particle of the toner, be 40% by area or less.

The area proportion is preferably 35% by area or less, and more preferably 28% by area or less. Meanwhile, the lower limit is not particularly limited, but is preferably 0% by area or more.

That is, most of the fine particles C are shown not to be embedded in the toner particle. As a result, the fine particles B and the fine particles C in the vicinity of the toner particle surface interact, the dispersibility of the fine particles C on the toner particle surface is improved, and the uniformity of image density is further improved.

The proportion of the area taken by the fine particles C can be controlled by changing the production conditions when the fine particles C are added to the toner particles, the glass transition temperature Tg (° C.) of the toner particles, and the number average particle diameter of the primary particles of the fine particles C.

The amount of the fine particles C is preferably from 0.3 parts by mass to 2.0 parts by mass with respect to 100 parts by mass of the toner particle.

The fine particles A will be described hereinbelow. The fine particles A are formed of a fatty acid metal salt.

The fatty acid metal salt is preferably a salt of at least one metal selected from the group consisting of zinc, calcium, magnesium, aluminum, and lithium. Further, a fatty acid zinc salt or a fatty acid calcium salt is more preferable, and a fatty acid zinc salt is even more preferable. When these are used, the effect of the present invention becomes more prominent.

As the fatty acid of the fatty acid metal salt, a higher fatty acid having from 8 to 28 carbon atoms (more preferably, from 12 to 22 carbon atoms) is preferable. The metal is preferably a divalent or higher polyvalent metal. That is, the fine particles A are preferably a fatty acid metal salt of a divalent or higher (more preferably divalent or trivalent, more preferably divalent) polyvalent metal and a fatty acid having from 8 to 28 (more preferably from 12 to 22) carbon atoms.

When a fatty acid having 8 or more carbon atoms is used, generation of free fatty acid is easily suppressed. The free fatty acid amount is preferably 0.20% by mass or less. Where the fatty acid has 28 or fewer carbon atoms, the melting point of the fatty acid metal salt does not become too high, and the fixing performance is unlikely to be inhibited. Stearic acid is particularly preferred as the fatty acid. The divalent or higher polyvalent metal preferably includes zinc.

Examples of fatty acid metal salts include metal stearates such as zinc stearate, calcium stearate, magnesium stearate, aluminum stearate, lithium stearate, and the like, and zinc laurate.

Where an average theoretical surface area obtained from a number average particle diameter, particle size distribution and true density of the toner particles measured by a Coulter counter is denoted by C ($m^2/g$), an amount of the fine particles A with respect to 100 parts by mass of the toner particle is denoted by D (parts by mass), and a coverage ratio of the toner particle surface by the fine particles A is denoted by E (%), following formulas (1) and (2) are satisfied.

$$0.03 \leq D/C \leq 1.50 \quad (1)$$

$$E/(D/C) \leq 50.0 \quad (2)$$

The average theoretical surface area C ($m^2/g$) is preferably from 0.60 to 1.50, and more preferably from 0.90 to 1.10.

The coverage ratio E (%) is preferably from 0.3 to 40.0, and more preferably from 0.5 to 20.0.

D/C is an expression making it possible to understand how much the fine particles A cover the toner particle when the toner particle is spherical, and D/C is defined as "theoretical coverage ratio". E/(D/C) is an expression representing the degree of actual coverage with respect to the "theoretical coverage ratio".

D/C needs to be from 0.03 to 1.50. Where D/C is less than 0.03, the migration of the fine particles A to the surface of the photosensitive member is not sufficient, and it becomes difficult to suppress the image smearing. Meanwhile, where D/C exceeds 1.50, the suppression of charge-up by the fine particles B becomes insufficient, and the retransfer occurs. D/C is preferably from 0.05 to 1.50, and more preferably from 0.10 to 1.50.

It is important that E/(D/C) be 50.0 or less. The E/(D/C) being 50.0 or less indicates that the actual coverage ratio is lower than the "theoretical coverage ratio". This means, as mentioned hereinabove, that the fatty acid metal salt is attached of fixed in the form of particles, without stretching, to the toner particle surface.

When E/(D/C) exceeds 50.0, the external addition stretches the fatty acid metal salt present on the toner particle surface. In this case, the charge accumulated in the toner after long-term use cannot be efficiently released, and the retransfer occurs.

E/(D/C) is preferably 45.0 or less, more preferably 40.0 or less. Meanwhile, the lower limit is not particularly limited, but is preferably 3.0 or more, and more preferably 10.0 or more.

Means for fitting into the range of the above formula (2) can be exemplified by design of toner particles and optimization of mixing process conditions and the like.

The addition amount (amount D) of the fatty acid metal salt is preferably from 0.02 parts by mass to 1.80 parts by mass, and more preferably from 0.10 parts by mass to 0.50 parts by mass, based on 100 parts by mass of the toner particle. Where the addition amount is 0.02 parts by mass or more, the effect of addition can be obtained. Where the amount is less than 1.80 parts by mass, the attachment to a developing blade or the like is suppressed, and image defects such as development streaks hardly occur.

The median diameter (D50s) of the fatty acid metal salt (fine particles A) on a volume basis is preferably from 0.15 μm to 3.00 μm, and more preferably from 0.30 μm to 3.00 μm. Where the median diameter is 0.15 μm or more, the fatty acid metal salt is sufficiently transferred to the photosensitive member surface, and the image smearing is easily suppressed. Further, when the particle diameter is 3.00 μm or less, the attachment to a developing blade or the like is suppressed, and image defects such as development streaks do not easily occur.

The fatty acid metal salt preferably has a span value B defined by the following formula (4) of 1.75 or less.

$$\text{Span value } B=(D95s-D5s)/D50s \quad (4)$$

D5s: 5% integrated diameter of the fatty acid metal salt on a volume basis.

D50s: 50% integrated diameter of the fatty acid metal salt on a volume basis.

D95s: 95% integrated diameter of the fatty acid metal salt on a volume basis.

The span value B is an index indicating the particle size distribution of the fatty acid metal salt. Where the span value B is 1.75 or less, the spread of the particle diameter of the fatty acid metal salt present in the toner becomes small, so that a better charge stability can be obtained. Therefore, the amount of toner charged to the opposite polarity is reduced, and the retransfer can be suppressed. The span value B is more preferably 1.50 or less because a more stable image is obtained. A more preferable value is 1.35 or less. The lower limit is not particularly limited, but is preferably 0.50 or more.

When the fixing ratio of the fine particles A to the toner particle is denoted by G (%), a relationship between the area ratio F and G preferably satisfies a following formula (3), and more preferably satisfies a formula (3').

$$2.0 \leq (100-G)/(100-F) \leq 8.0 \quad (3)$$

$$3.0 \leq (100-G)/(100-F) \leq 6.0 \quad (3')$$

Within those ranges, the image smearing can be largely suppressed, and development streaks can be suppressed. The abovementioned range can be realized by a high degree of embedding of the fine particles B and by attaching and fixing the fatty acid metal salt at a low coverage ratio relative to the amount.

In other words, since the fine particles B are partially attached, in the form satisfying the abovementioned formulas, to the fatty acid metal salt migrating to the photosensitive member surface, and form composites therewith, it is possible, as mentioned hereinabove, to suppress the image smearing significantly. Further, as a result of the fine particles A and the fine particles B forming composites, the adhesive force of the fine particles A to the blade is also reduced by the fine particles B, so that fusion to the blade is reduced and the particles easily pass by the developing blade, thereby making it possible to suppress also the development streaks.

The fixing ratio G (%) of the fine particles A to the toner particle is preferably from 0.0 to 8.0, and more preferably from 0.0 to 6.0.

By controlling the particle diameter of the fine particles A and the mechanical impact force (peripheral speed and time of stirring) in the external addition step (the step of mixing the toner particles with the fine particles A), the fixing ratio G of the fine particles A can be controlled to a preferable range.

The fine particles B will be described hereinbelow. The fine particles B may have a volume resistivity of from $5.0\times10$ Ωm to $1.0\times10^8$ Ωm, and preferably contain at least one kind of particles selected from the group consisting of titanium oxide fine particles, strontium titanate fine particles, and alumina fine particles. More preferably, the fine particles B is at least one kind of particles selected from the group consisting of titanium oxide fine particles, strontium titanate fine particles, and alumina fine particles. At least one kind of particles selected from the group consisting of titanium oxide fine particles and strontium titanate fine particles are more preferable, and strontium titanate is even more preferable.

Since strontium titanate has a hexahedral shape and can increase the contact area with the toner particle, it is possible to efficiently release the charges accumulated in the toner particle due to the durable use. Further, composite oxide fine particles using two or more kinds of metals can also be used, and two or more kinds selected in an arbitrary combination from among these fine particle groups can also be used.

The fine particles B may be surface-treated for the purpose of imparting hydrophobicity.

Examples of the hydrophobizing agent include chlorosilanes such as methyltrichlorosilane, dimethyldichlorosilane, trimethylchlorosilane, phenyltrichlorosilane, diphenyldichlorosilane, t-butyldimethylchlorosilane, vinyltrichlorosilane, and the like;

alkoxysilanes such as tetramethoxysilane, methyltrimethoxysilane, dimethyldimethoxysilane, phenyltrimethoxysilane, diphenyldimethoxysilane, o-methylphenyltrimethoxysilane, p-methylphenyltrimethoxysilane, n-butyltrimethoxysilane, i-butyltrimethoxysilane, hexyltrimethoxysilane, octyltrimethoxysilane, decyltrimethoxysilane, dodecyltrimethoxysilane, tetraethoxysilane, methyltriethoxysilane, dimethyldiethoxysilane, phenyltriethoxysilane, diphenyldiethoxysilane, i-butyltriethoxysilane, decyltriethoxysilane, vinyltriethoxysilane, γ-methacryloxypropyltrimethoxysilane, γ-glycidoxypropyltrimethoxysilane, γ-glycidoxypropylmethyldimethoxysilane, γ-mercaptopropyltrimethoxysilane, γ-chloropropyltrimethoxysilane, γ-aminopropyltrimethoxysilane, γ-aminopropyltriethoxysilane, γ-(2-aminoethyl)aminopropyltrimethoxysilane, γ-(2-aminoethyl)aminopropylmethyldimethoxysilane, and the like;

silazane such as hexamethyldisilazane, hexaethyldisilazane, hexapropyldisilazane, hexabutyldisilazane, hexapentyldisilazane, hexahexyldisilazane, hexacyclohexyldisilazane, hexaphenyldisilazane, divinyltetramethyldisilazane, dimethyltetravinyldisilazane, and the like;

silicone oils such as dimethyl silicone oil, methyl hydrogen silicone oil, methyl phenyl silicone oil, alkyl-modified silicone oil, chloroalkyl-modified silicone oil, chlorophenyl-modified silicone oil, fatty acid-modified silicone oil, polyether-modified silicone oil, alkoxy-modified silicone oil, carbinol-modified silicone oils, amino-modified silicone oils, fluorine-modified silicone oils, terminal-reactive silicone oils, and the like;

siloxanes such as hexamethylcyclotrisiloxane, octamethylcyclotetrasiloxane, decamethylcyclopentasiloxane, hexamethyldisiloxane, octamethyltrisiloxane, and the like.

Examples of fatty acids and metal salts thereof include long-chain fatty acids such as undecylic acid, lauric acid, tridecylic acid, dodecylic acid, myristic acid, palmitic acid, pentadecylic acid, stearic acid, heptadecylic acid, arachinic acid, montanic acid, oleic acid, linoleic acid, arachidonic acid, and the like, and salts of the fatty acids with metals such as zinc, iron, magnesium, aluminum, calcium, sodium, lithium, and the like.

Among these, alkoxysilanes, silazanes, and silicone oils are preferably used because they facilitate a hydrophobic treatment. One of these hydrophobizing agents may be used alone, or two or more of them may be used in combination.

The fine particles C will be described hereinbelow. The fine particles C are formed of silica fine particles, and may be those obtained by a dry method, such as fumed silica, or those obtained by a wet method such as a sol-gel method. From the viewpoint of charging performance, it is preferable to use silica fine particles obtained by a dry method.

Furthermore, the fine particles C may be surface-treated for the purpose of imparting hydrophobicity and flowability. The hydrophobic method can be exemplified by a method for chemically treating with an organosilicon compound which reacts or physically adsorbs with silica fine particles. In a preferred method, silica produced by vapor phase oxidation of a silicon halide is treated with an organosilicon compound. Examples of such organosilicon compound are listed hereinbelow.

Hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, and benzyldimethylchlorosilane.

Other examples include bromomethyldimethylchlorosilane, α-chloroethyltrichlorosilane, β-chloroethyltrichlorosilane, chloromethyldimethylchlorosilane, triorganosilylmercaptan, trimethylsilylmercaptan, and triorganosilyl acrylate.

Further, other examples include vinyldimethylacetoxysilane, dimethylethoxysilane, dimethyldimethoxysilane, diphenyldiethoxysilane, and 1-hexamethyldisiloxane.

Other examples include 1,3-divinyltetramethyldisiloxane, 1,3-diphenyltetramethyldisiloxane, and dimethylpolysiloxanes having from 2 to 12 siloxane units per molecule and having one hydroxyl group per each Si in the terminal unit. These are used alone or as a mixture of two or more.

In the silica treated with silicone oil, a preferred silicone oil has a viscosity at 25° C. of from 30 $mm^2/s$ to 1000 $mm^2/s$.

Examples include dimethyl silicone oil, methylphenyl silicone oil, α-methylstyrene-modified silicone oil, chlorophenyl silicone oil, and fluorine-modified silicone oil.

The following methods can be used for silicone oil treatment.

A method in which silica treated with a silane coupling agent and silicone oil are directly mixed using a mixer such as a Henschel mixer.

A method for spraying silicone oil on silica as a base. Alternatively, a method for dissolving or dispersing a silicone oil in an appropriate solvent, then adding silica, mixing and removing the solvent.

The silica treated with silicone oil is more preferably heated to a temperature of 200° C. or more (more preferably 250° C. or more) in an inert gas after the treatment with the silicone oil to stabilize the surface coat.

A preferred silane coupling agent is hexamethyldisilazane (HMDS).

To improve the performance of the toner, the toner may further include other external additives.

A preferred production method for adding the fine particles A, the fine particles B and the fine particles C will be described hereinbelow.

In order to create a structure in which the fine particles B are embedded in the surface of the toner particle while preventing the fine particles A from being embedded, it is preferable to divide the step of adding the fine particles B and the fine particles A into two stages. That is, it is preferable to include a step of adding the fine particles B to the toner particle and a step of adding the fine particles A (and optionally the fine particles C) to the toner particle to which the fine particles B have been added.

In the steps of adding the fine particles B and the fine particles A to the toner particles, the fine particles may be added as external additives by a dry method, may be added by a wet method, or each method may be used in two stages. In particular, from the viewpoint of controllability of the presence state of the fine particles B and the fine particles A, it is more preferable to use a two-stage external addition process.

In order to embed the fine particles B in the surface of the toner particle, it is preferable to heat an external addition device in the external addition step (the step of mixing the fine particles B with the toner particle) and embed the fine particles B by heat. A mechanical impact force can be applied to embed the fine particles B in the toner particle surface softened slightly by heat. Further, a method in which the toner particle and the fine particles B are mixed in the external addition step, and then a heating step is performed in the same device or another device to embed the fine particles B may be used.

In order to achieve the embedding of the fine particles B, it is preferable to set the temperature of the external addition step near the glass transition temperature Tg of the toner particles.

A temperature $T_B$ in the external addition step of the fine particles B is preferably Tg−10° C. $T_B \leq$ Tg+5° C., where Tg is the glass transition temperature of the toner particle.

In addition, from the viewpoint of storage stability, the glass transition temperature Tg of the toner particle is preferably from 40° C. to 70° C., and more preferably from 50° C. to 65° C.

As a device to be used in the external addition step of the fine particles B, a device having a mixing function and a function of giving a mechanical impact force is preferable, and a known mixing processing device can be used. For example, by using a known mixer such as an FM MIXER (manufactured by Nippon Coke Industry Co., Ltd.), a SUPER MIXER (manufactured by Kawata Mfg. Co., Ltd.), a HYBRIDIZER (manufactured by Nara Machinery Co., Ltd.), or the like, and by warming, the fine particles B can be embedded in the toner particle.

The dispersion degree evaluation index of the fine particles Bon the toner surface is preferably 0.4 or less, and more preferably 0.3 or less. The lower limit is not particularly limited, but is preferably 0.0 or more. Within the above range, the fine particles B effectively function as charge leak sites. It is preferable to set the external addition conditions so that the dispersibility of the fine particles B is improved.

Described hereinbelow is a preferred method for adding the fine particles A to the toner particle in which the fine particles B have been embedded. It is important that most of the fine particles A be not embedded in the toner particle. In order to achieve such a structure, the same device as that used in the step of externally adding the fine particles B can be used.

When externally adding the fine particles A, it is not necessary to warm the mixer, and the temperature $T_A$ in the external addition step of the fine particles A preferably satisfies the condition of $T_A \leq$ Tg−15° C. with respect to the glass transition temperature Tg of the toner.

Next, a preferred method for adding the fine particles C to the toner particle in which the fine particles B are embedded will be described. The fine particles C are preferably added in a dry external addition step, and the same apparatus as used in the external addition step of the fine particles B can be used.

When externally adding the fine particles C, it is not necessary to warm the mixer, and the temperature $T_C$ in the external addition step of the fine particles C preferably satisfies the condition of $T_C \leq Tg-15°$ C. with respect to the glass transition temperature Tg of the toner. The timing of adding the fine particles C may be such that the fine particles A and the fine particles C are simultaneously externally added to the toner particles in which the fine particles B have been embedded, or such that the fine particles C are externally added after the fine particles A have been added to the toner particle in which the fine particles B were embedded.

The method for manufacturing the toner particle is explained. The toner particle manufacturing method is not particularly limited, and a known method may be used, such as a kneading pulverization method or wet manufacturing method. A wet method is preferred for obtaining a uniform particle diameter and controlling the particle shape. Examples of wet manufacturing methods include suspension polymerization methods dissolution suspension methods, emulsion polymerization aggregation methods, emulsion aggregation methods and the like, and an emulsion aggregation method may be used by preference.

In emulsion aggregation methods, a fine particle of a binder resin and a fine particle of another material such as a colorant as necessary are dispersed and mixed in an aqueous medium containing a dispersion stabilizer. A surfactant may also be added to this aqueous medium. A flocculant is then added to aggregate the mixture until the desired toner particle size is reached, and the resin fine particles are also melt adhered together either after or during aggregation. Shape control with heat may also be performed as necessary in this method to form a toner particle.

The fine particle of the binder resin here may be a composite particle formed as a multilayer particle comprising two or more layers composed of different resins. For example, this can be manufactured by an emulsion polymerization method, mini-emulsion polymerization method, phase inversion emulsion method or the like, or by a combination of multiple manufacturing methods.

When the toner particle contains an internal additive, the internal additive may be included in the resin fine particle. A liquid dispersion of an internal additive fine particle consisting only of the internal additive may also be prepared separately, and the internal additive fine particle may then be aggregated together with the resin fine particle when aggregating. Resin fine particles with different compositions may also be added at different times during aggregation, and aggregated to prepare a toner particle composed of layers with different compositions.

The following may be used as the dispersion stabilizer:

inorganic dispersion stabilizers such as tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica and alumina.

Other examples include organic dispersion stabilizers such as polyvinyl alcohol, gelatin, methyl cellulose, methyl hydroxypropyl cellulose, ethyl cellulose, carboxymethyl cellulose sodium salt, and starch.

A known cationic surfactant, anionic surfactant or nonionic surfactant may be used as the surfactant.

Specific examples of cationic surfactants include dodecyl ammonium bromide, dodecyl trimethylammonium bromide, dodecylpyridinium chloride, dodecylpyridinium bromide, hexadecyltrimethyl ammonium bromide and the like.

Specific examples of nonionic surfactants include dodecylpolyoxyethylene ether, hexadecylpolyoxyethylene ether, nonylphenylpolyoxyethylene ether, lauryl polyoxyethylene ether, sorbitan monooleate polyoxyethylene ether, styrylphenyl polyoxyethylene ether, monodecanoyl sucrose and the like.

Specific examples of anionic surfactants include aliphatic soaps such as sodium stearate and sodium laurate, and sodium lauryl sulfate, sodium dodecylbenzene sulfonate, sodium polyoxyethylene (2) lauryl ether sulfate and the like.

The binder resin constituting the toner is explained next.

Preferred examples of the binder resin include vinyl resins, polyester resins and the like. Examples of vinyl resins, polyester resins and other binder resins include the following resins and polymers:

monopolymers of styrenes and substituted styrenes, such as polystyrene and polyvinyl toluene; styrene copolymers such as styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer and styrene-maleic acid ester copolymer; and polymethyl methacryalte, polybutyl methacrylate, polvinyl acetate, polyethylene, polypropylene, polvinyl butyral, silicone resin, polyamide resin, epoxy resin, polyacrylic resin, rosin, modified rosin, terpene resin, phenol resin, aliphatic or alicyclic hydrocarbon resins and aromatic petroleum resins.

These binder resins may be used individually or mixed together.

Examples of the polymerizable monomers that can be used in the production of vinyl resins include styrene monomers such as styrene, α-methylstyrene, and the like; acrylic esters such as methyl acrylate, butyl acrylate, and the like; methacrylic acid esters such as methyl methacrylate, 2-hydroxyethyl acrylate, t-butyl methacrylate, 2-ethylhexyl methacrylate, and the like; unsaturated carboxylic acids such as acrylic acid, methacrylic acid, and the like; unsaturated dicarboxylic acids such as maleic acid and the like; unsaturated dicarboxylic anhydrides such as maleic anhydride and the like; nitrile vinyl monomers such as acrylonitrile and the like; halogen-containing vinyl monomers such as vinyl chloride and the like; and nitro vinyl monomers such as nitrostyrene and the like.

The binder resin preferably contains carboxyl groups, and is preferably a resin manufactured using a polymerizable monomer containing a carboxyl group. The polymerizable monomer containing a carboxyl group includes, for xample, vinylic carboxylic acids such as acrylic acid, methacrylic acid, α-ethylacrylic acid and crotonic acid; unsaturated dicarboxylic acids such as fumaric acid, maleic acid, citraconic acid and itaconic acid; and unsaturated dicarboxylic acid monoester derivatives such as monoacryloyloxyethyl succinate ester, monomethacryloyloxyethyl succinate ester, monoacryloyloxyethyl phthalate ester and monomethacryloyloxyethyl phthalate ester.

Polycondensates of the carboxylic acid components and alcohol components listed below may be used as the polyester resin. Examples of carboxylic acid components include terephthalic acid, isophthalic acid, phthalic acid, fumaric acid, maleic acid, cyclohexanedicarboxylic acid and trimellitic acid. Examples of alcohol components include bisphenol A, hydrogenated bisphenols, bisphenol A ethylene oxide adduct, bisphenol A propylene oxide adduct, glycerin, trimethyloyl propane and pentaerythritol.

The polyester resin may also be a polyester resin containing a urea group. Preferably the terminal and other carboxyl groups of the polyester resins are not capped.

To control the molecular weight of the binder resin constituting the toner particle, a crosslinking agent may also be added during polymerization of the polymerizable monomers.

Examples include ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, divinyl benzene, bis (4-acryloxypolyethoxyphenyl) propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycol #200, #400 and #600, dipropylene glycol diacrylate, polypropylene glycol diacrylate, polyester diacrylate (MANDA, Nippon Kayaku Co., Ltd.), and these with methacrylate substituted for the acrylate.

The added amount of the crosslinking agent is preferably from 0.001 mass parts to 15.000 mass parts per 100 mass parts of the polymerizable monomers.

The toner particle preferably includes a release agent. It is preferable that the toner particle include an ester wax having a melting point of from 60° C. to 90° C. (more preferably, from 60° C. to 80° C.). Such a wax is excellent in compatibility with the binder resin, so that a plastic effect can be easily obtained, and the fine particles B can be efficiently embedded in the toner particle surface.

Examples of ester waxes include waxes consisting primarily of fatty acid esters, such as carnauba wax and montanic acid ester wax; fatty acid esters in which the acid component has been partially or fully deacidified, such as deacidified carnauba wax; hydroxyl group-containing methyl ester compounds obtained by hydrogenation or the like of plant oils and fats; saturated fatty acid monoesters such as stearyl stearate and behenyl behenate; diesterified products of saturated aliphatic dicarboxylic acids and saturated fatty alcohols, such as dibehenyl sebacate, distearyl dodecanedioate and distearyl octadecanedioate; and diesterified products of saturated aliphatic diols and saturated aliphatic monocarboxylic acids, such as nonanediol dibehenate and dodecanediol distearate.

Of these waxes, it is desirable to include a bifunctional ester wax (diester) having two ester bonds in the molecular structure.

A bifunctional ester wax is an ester compound of a dihydric alcohol and an aliphatic monocarboxylic acid, or an ester compound of a divalent carboxylic acid and a fatty monoalcohol.

Specific examples of the aliphatic monocarboxylic acid include myristic acid, palmitic acid, stearic acid, arachidic acid, behenic acid, lignoceric acid, cerotic acid, montanic acid, melissic acid, oleic acid, vaccenic acid, linoleic acid and linolenic acid.

Specific examples of the fatty monoalcohol include myristyl alcohol, cetanol, stearyl alcohol, arachidyl alcohol, behenyl alcohol, tetracosanol, hexacosanol, octacosanol and triacontanol.

Specific examples of the divalent carboxylic acid include butanedioic acid (succinic acid), pentanedioic acid (glutaric acid), hexanedioic acid (adipic acid), heptanedioic acid (pimelic acid), octanedioic acid (suberic acid), nonanedioic acid (azelaic acid), decanedioic acid (sebacic acid), dodecanedioic acid, tridecaendioic acid, tetradecanedioic acid, hexadecanedioic acid, octadecanedioic acid, eicosanedioic acid, phthalic acid, isophthalic acid, terephthalic acid and the like.

Specific examples of the dihydric alcohol include ethylene glycol, propylene glycol, 1,3-propanediol, 1,4-butanediol, 1,5-pentanediol, 1,6-hexanediol, 1,10-decanediol, 1,12-dodecanediol, 1,14-tetradecanediol, 1,16-hexadecanediol, 1,18-octadecanediol, 1,20-eicosanediol, 1,30-triacontanediol, diethylene glycol, dipropylene glycol, 2,2,4-trimethyl-1,3-pentanediol, neopentyl glycol, 1,4-cyclohexane dimethanol, spiroglycol, 1,4-phenylene glycol, bisphenol A, hydrogenated bisphenol A and the like.

Other release agents that can be used include petroleum waxes and their derivatives, such as paraffin wax, microcrystalline wax and petrolatum, montanic wax and its derivatives, hydrocarbon waxes obtained by the Fischer-Tropsch method, and their derivatives, polyolefin waxes such as polyethylene and polypropylene, and their derivatives, natural waxes such as carnauba wax and candelilla wax, and their derivatives, higher fatty alcohols, and fatty acids such as stearic acid and palmitic acid.

The content of the release agent is preferably from 5.0 mass parts to 20.0 mass parts per 100.0 mass parts of the binder resin.

A colorant may also be included in the toner. The colorant is not specifically limited, and the following known colorants may be used.

Examples of yellow pigments include yellow iron oxide, Naples yellow, naphthol yellow S, Hansa yellow G, Hansa yellow OG, benzidine yellow G, benzidine yellow GR, quinoline yellow lake, permanent yellow NCG, condensed azo compounds such as tartrazine lake, isoindolinone compounds, anthraquinone compounds, azo metal complexes, methine compounds and allylamide compounds. Specific examples include:

C.I. pigment yellow 12, 13, 14, 15, 17, 62, 74, 83, 93, 94, 95, 109, 110, 111, 128, 129, 147, 155, 168 and 180.

Examples of red pigments include red iron oxide, permanent red 4R, lithol red, pyrazolone red, watching red calcium salt, lake red C, lake red D, brilliant carmine 6B, brilliant carmine 3B, eosin lake, rhodamine lake B, condensed azo compounds such as alizarin lake, diketopyrrolopyrrole compounds, anthraquinone compounds, quinacridone compounds, basic dye lake compounds, naphthol compounds, benzimidazolone compounds, thioindigo compound and perylene compounds. Specific examples include:

C.I. pigment red 2, 3, 5, 6, 7, 23, 48:2, 48:3, 48:4, 57:1, 81:1, 122, 144, 146, 166, 169, 177, 184, 185, 202, 206, 220, 221 and 254.

Examples of blue pigments include alkali blue lake, Victoria blue lake, phthalocyanine blue, metal-free phthalocyanine blue, phthalocyanine blue partial chloride, fast sky blue, copper phthalocyanine compounds such as indathrene blue BG and derivatives thereof, anthraquinone compounds and basic dye lake compounds. Specific examples include:

C.I. pigment blue 1, 7, 15, 15:1, 15:2, 15:3, 15:4, 60, 62 and 66.

Examples of black pigments include carbon black and aniline black. These colorants may be used individually, or as a mixture, or in a solid solution.

The content of the colorant is preferably from 3.0 mass parts to 15.0 mass parts per 100.0 mass parts of the binder resin.

The toner particle may also contain a charge control agent. A known charge control agent may be used. A charge control agent that provides a rapid charging speed and can stably maintain a uniform charge quantity is especially desirable.

Examples of charge control agents for controlling the negative charge properties of the toner particle include:

organic metal compounds and chelate compounds, including monoazo metal compounds, acetylacetone metal compounds, aromatic oxycarboxylic acids, aromatic dicarboxylic acids, and metal compounds of oxycarboxylic acids and dicarboxylic acids. Other examples include aromatic oxycarboxylic acids, aromatic mono- and polycarboxylic acids and their metal salts, anhydrides and esters, and phenol derivatives such as bisphenols and the like. Further examples include urea derivatives, metal-containing salicylic acid compounds, metal-containing naphthoic acid compounds, boron compounds, quaternary ammonium salts and calixarenes.

Meanwhile, examples of charge control agents for controlling the positive charge properties of the toner particle include nigrosin and nigrosin modified with fatty acid metal salts; guanidine compounds; imidazole compounds; quaternary ammonium salts such as tributylbenzylammonium-1-hydroxy-4-naphthosulfonate salt and tetrabutylammonium tetrafluoroborate, onium salts such as phosphonium salts that are analogs of these, and lake pigments of these; triphenylmethane dyes and lake pigments thereof (using phosphotungstic acid, phosphomolybdic acid, phosphotungstenmolybdic acid, tannic acid, lauric acid, gallic acid, ferricyanic acid or a ferrocyan compound or the like as the laking agent); metal salts of higher fatty acids; and resin charge control agents.

One of these charge control agents alone or a combination of two or more may be used. The added amount of these charge control agents is preferably from 0.01 mass parts to 10.00 mass parts per 100.00 mass parts of the polymerizable monomers.

Methods for measuring various physical properties are described hereinbelow. Measurement of Median Diameter and Span Value of Fine Particles A The volume-based median diameter of the fatty acid metal salt is measured in accordance with JIS Z 8825-1 (2001), and is specifically as follows.

As a measuring device, a laser diffraction/scattering type particle size distribution measuring device "LA-920" (manufactured by Horiba, Ltd.) is used. Setting of measurement conditions and analysis of measurement data are performed using dedicated software "HORIBA LA-920 for Windows® WET (LA-920) Ver. 2.02" provided with LA-920. In addition, ion-exchanged water from which impurity solids and the like have been removed in advance is used as the measurement solvent.

The measurement procedure is as follows.

(1) A batch-type cell holder is attached to LA-920.

(2) A predetermined amount of ion-exchanged water is put into a batch-type cell, and the batch-type cell is set in the batch-type cell holder.

(3) The inside of the batch type cell is stirred using a dedicated stirrer tip.

(4) The "REFRACTIVE INDEX" button on the "DISPLAY CONDITION SETTING" screen is pushed and the file "110A000I" (relative refractive index 1.10) is selected.

(5) On the "DISPLAY CONDITION SETTING" screen, the particle diameter is set to be on the volume basis.

(6) After performing the warm-up operation for 1 h or more, adjustment of optical axes, fine adjustment of optical axes, and blank measurement are performed.

(7) About 60 ml of ion-exchanged water is put into a glass 100-ml flat-bottom beaker. As a dispersing agent, about 0.3 ml of a diluted solution prepared by about three-fold mass dilution of "CONTAMINON N" (a 10% by mass aqueous solution of a neutral detergent for cleaning precision measuring instruments; has a pH of 7 and includes a nonionic surfactant, an anionic surfactant and an organic builder, manufactured by Wako Pure Chemical Industries, Ltd.) with ion-exchanged water is added.

(8) An ultrasonic disperser "Ultrasonic Dispersion System Tetora 150" (manufactured by Nikkaki Bios Inc.) which has an electric output of 120 W and in which two oscillators having an oscillation frequency of 50 kHz are incorporated with a phase difference of 180 degrees is prepared. About 3.3 L of ion-exchanged water is put into the water tank of the ultrasonic disperser, and about 2 ml of CONTAMINON N is added to the water tank.

(9) The beaker of (7) is set in the beaker fixing hole of the ultrasonic disperser, and the ultrasonic disperser is operated. Then, the height position of the beaker is adjusted so that the resonance state of the liquid surface of the aqueous solution in the beaker is maximized.

(10) While irradiating the aqueous solution in the beaker of (9) with ultrasonic waves, about 1 mg of the fatty acid metal salt is added little by little to the aqueous solution in the beaker and dispersed. Then, the ultrasonic dispersion processing is continued for another 60 sec. In this case, the fatty acid metal salt sometimes floats as a lump on the liquid surface. In this case, the lump is submerged in water by rocking a beaker, and then ultrasonic dispersion is performed for 60 sec. In the ultrasonic dispersion, the water temperature of the water tank is adjusted, as appropriate, to be from 10° C. to 40° C.

(11) The aqueous solution which has been prepared in (10) and in which the fatty acid metal salt has been dispersed is immediately added little by little to the batch type cell while taking care not to introduce air bubbles, and the transmittance of the tungsten lamp is adjusted to be from 90% to 95%. Then, the particle size distribution is measured. Based on the obtained volume-based particle size distribution data, a 5% integrated diameter, a 50% integrated diameter, and a 95% integrated diameter from the small particle diameter side are calculated.

The obtained values are denoted by D5s, D50s, and D95s, and the span value is determined from these values.

Method for Measuring True Density of Toner Particles

When measuring the true density of toner particle in a toner in which an external additive is externally added to the toner particles, the external additive is removed. The specific method is described hereinbelow.

A total of 160 g of sucrose (manufactured by Kishida Chemical) is added to 100 mL of ion-exchanged water, and dissolved in a water bath to prepare a concentrated sucrose solution. A total of 31 g of the concentrated sucrose solution and 6 mL of CONTAMINON N are placed in a tube for centrifugation to prepare a dispersion liquid. A total of 1 g of the toner is added to the dispersion liquid, and the lumps of the toner are loosened with a spatula or the like.

The tube for centrifugation is shaken for 20 min on a shaker ("KM Shaker" manufactured by Iwaki Sangyo Co., Ltd.) at a condition of 350 strokes per min. After shaking, the solution is transferred to a glass tube (50 mL) for a swing rotor, and centrifuged under conditions of 3500 rpm and 30 min in a centrifuge (H-9R; manufactured by Kokusan Co., Ltd.). In the glass tube after the centrifugation, toner particles are present in the uppermost layer and an external additive is present in the lower layer on the aqueous solution side, so that only the toner particles in the uppermost layer are collected.

Where the external additives have not been sufficiently removed, centrifugation is repeated as necessary, and after sufficient separation, the toner liquid is dried to collect toner particles.

The true density of the toner particles is measured by a dry automatic densitometer—auto pycnometer (manufactured by Yuasa Ionics Co., Ltd.). The conditions are as follows.

Cell: SM cell (10 ml)

Sample amount: about 2.0 g

With this measurement method, the true density of solids and liquids is measured based on a gas phase replacement method. Similar to the liquid phase replacement method, it is based on Archimedes' principle, but since gas (argon gas) is used as the replacement medium, the precision for micropores is high.

Method for Measuring Weight Average Particle Diameter (D4) and Number Average Particle Diameter (D1) of Toner Particles The weight-average particle diameter (D4) and Number Average Particle Diameter (D1) of the toner particle is calculated as follows. A "Multisizer (R) 3 Coulter Counter" precise particle size distribution analyzer (Beckman Coulter, Inc.) based on the pore electrical resistance method and equipped with a 100 m aperture tube is used together with the accessory dedicated "Beckman Coulter Multisizer 3 Version 3.51" software (Beckman Coulter, Inc.) for setting measurement conditions and analyzing measurement data, and measurement and analysis is performed.

The aqueous electrolytic solution used in measurement may be a solution of special grade sodium chloride dissolved in ion-exchanged water to a concentration of about 1 mass %, such as "ISOTON II" (Beckman Coulter, Inc.) for example.

The following settings are performed on the dedicated software prior to measurement and analysis.

On the "Change standard measurement method (SOM)" screen of the dedicated software, the total count number in control mode is set to 50000 particles, the number of measurements to 1, and the Kd value to a value obtained with "Standard particles 10.0 μm" (Beckman Coulter, Inc.). The threshold noise level is set automatically by pushing the "Threshold/noise level measurement" button. The current is set to 1600 μA, the gain to 2, and the electrolyte solution to ISOTON II, and a check is entered for "Aperture tube flush after measurement".

On the "Conversion settings from pulse to particle diameter" screen of the dedicated software, the bin interval is set to the logarithmic particle diameter, the particle diameter bins to 256, and the particle diameter range to 2 m to 60 μm.

The specific measurement methods are as follows.

(1) About 200 ml of the aqueous electrolytic solution is added to a dedicated glass 250 ml round-bottomed beaker of the Multisizer 3, the beaker is set on the sample stand, and stirring is performed with a stirrer rod counter-clockwise at a rate of 24 rps. Contamination and bubbles in the aperture tube are then removed by the "Aperture flush" function of the dedicated software.

(2) 30 ml of the same aqueous electrolytic solution is placed in a glass 100 ml flat-bottomed beaker, and about 0.3 ml of a dilution of "Contaminon N" (a 10% m by mass aqueous solution of a pH 7 neutral detergent for washing precision instruments, comprising a nonionic surfactant, an anionic surfactant, and an organic builder, manufactured by Wako Pure Chemical Industries, Ltd.) diluted 3-fold by mass with ion-exchange water is added.

(3) The prescribed amount of ion-exchange water is added to the water tank of an ultrasonic disperser "Ultrasonic Dispersion System Tetra150" (Nikkaki Bios Co., Ltd.) is prepared with an electrical output of 120 W equipped with two built-in oscillators having an oscillating frequency of 50 kHz with their phases shifted by 180 from each other, and about 2 ml of Contarninon N is added to the tank.

(4) The beaker of (2) above is set in the beaker-fixing hole of the ultrasonic disperser, and the ultrasonic disperser is operated. The height position of the beaker is adjusted so as to maximize the resonant condition of the liquid surface of the aqueous electrolytic solution in the beaker.

(5) The aqueous electrolytic solution in the beaker of (4) above is exposed to ultrasound as about 10 mg of toner particle is added bit by bit to the aqueous electrolytic solution, and dispersed. Ultrasound dispersion is then continued for a further 60 seconds. During ultrasound dispersion, the water temperature in the tank is adjusted appropriately to from 10° C. to 40° C.

(6) The aqueous electrolytic solution of (5) above with the toner particle dispersed therein is dripped with a pipette into the round-bottomed beaker of (1) above set on the sample stand, and adjusted to a measurement concentration of about 5%. Measurement is then performed until the number of measured particles reaches 50000.

(7) The measurement data is analyzed with the dedicated software included with the apparatus, and the weight-average particle diameter (D4) and Number Average Particle Diameter (D1) are calculated. The Number Average Particle Diameter (D1) and weight-average particle diameter (D4) are the "Arithmetic diameter" on the "Analysis/number statistic value (arithmetic mean)" screen or "Analysis/volume statistical value (arithmetic mean)" screen when graph/number % or graph/volume % is set in the dedicated software respectively.

Method for Calculating Average Theoretical Surface Area C Per Unit Mass of Toner Particle After obtaining the number average particle diameter (D1), the dedicated software "Beckman Coulter Multisizer 3 Version 3.51" (manufactured by Beckman Coulter, Inc.) provided for measurement data analysis is used to divide a range of from 2.0 to 32.0 μm into 12 channels (2.000 to 2.520 μm, 2.520 to 3.175 μm, 3.175 to 4.000 μm, 4.000 to 5.040 μm, 5.040 to 6.350 μm, 6.350 to 8.000 μm, 8.000 to 10.079 μm, 10.079 to 12.699 μm, 12.699 to 16.000 μm, 16.000 to 20.159 μm, 20.159 to 25.398 μm, and 25.398 to 32.000 μm), and the number ratio of toner particles in each particle diameter range is determined.

Thereafter, using the median value of each channel (for example, where the channel is from 2.000 to 2.520 μm, the median value is 2.260 μm), the theoretical surface area ($=4\times\pi\times(\text{median value of each channel})^2$) is obtained under an assumption that the toner particle with the median value of each channel is a true sphere. This theoretical surface area is multiplied by the previously determined number ratio of particles belonging to each channel to determine the average theoretical surface area (a) of one toner particle under an assumption that the measured toner particle is a true sphere.

Next, the theoretical mass (=4/3×π×(median value of each channel)$^3$×true density) is obtained in the same manner under an assumption that the toner particle with the median value of each channel is a true sphere from the median value of each channel and the measured true density of the toner particles. The average theoretical mass (b) of one toner particle is determined from the theoretical mass and the number ratio of the particles belonging to each channel which has been determined above.

From the above, the average theoretical surface area C ($m^2$/g) per unit mass of the measured toner particle is calculated from the average theoretical surface area and average theoretical mass of one toner particle.

Method for Measuring Coverage Ratio of Fine Particles A

The coverage ratio of the fine particles A is measured by ESCA (X-ray photoelectron spectroscopy) (Quantum 2000 manufactured by ULVAC-PHI).

A 75 mm square platen (provided with a screw hole of about 1 mm diameter for fixing the sample) attached to the device is used as the sample holder. Since the screw hole of the platen is a through hole, the hole is closed with a resin or the like, and a concave portion for measuring powder having a depth of about 0.5 mm is prepared. A measurement sample (toner or fine particles A (fatty acid metal salt) alone) is packed into the concave portion with a spatula or the like, and a sample is prepared by grinding.

ESCA measurement conditions are as follows.

Analysis method: narrow analysis
X-ray source: Al-Kα
X-ray conditions: 100μ, 25 W, 15 kV
Photoelectron capture angle: 45°
Pass Energy: 58.70 eV
Measuring range: ϕ100 μm First, the toner is measured. To calculate the quantitative value of metal atoms contained in the fine particles A, C 1s (B. E. 280 eV to 295 eV), O 1s (B. E. 525 eV to 540 eV), Si 2p (B. E. 95 eV to 113 eV) and the element peak of the metal atom of the fine particles A are used. The quantitative value of the metal element obtained here is denoted by X1.

Next, in the same manner, the elemental analysis of the fine particle A alone is performed, and the quantitative value of the element contained in the fine particle A obtained here is denoted by X2.

The coverage ratio is obtained from the following formula by using the X1 and X2.

$$\text{Coverage ratio (\%) of fine particles } A = X1/X2 \times 100$$

Measurement of Amount of Fine Particles A and B in Toner

The fine particles A and B are separated from the components of the toner and the amount thereof is measured by the following method.

A total of 1 g of the toner is added to and dispersed in 31 g of chloroform contained in a vial. The dispersion is performed using an ultrasonic homogenizer for 30 min to prepare a dispersion liquid. The treatment conditions are as follows. Ultrasonic treatment device: Ultrasonic Homogenizer VP-050 (manufactured by Taitec Corporation).

Microchip: step type microchip, tip diameter ϕ2 mm.

Tip position of microchip: the center of the glass vial at a height of 5 mm from the bottom of the vial.

Ultrasonic conditions: intensity 30%, 30 min. At this time, ultrasonic waves are applied while cooling the vial with ice water so as not to raise the temperature of the dispersion.

The dispersion liquid is transferred to a glass tube (50 mL) for a swing rotor and centrifuged at 58.33 $S^{-1}$ for 30 min using a centrifuge (H-9R; manufactured by Kokusan Co., Ltd.). Each material constituting the toner is separated in the glass tube after the centrifugation. Each material is extracted and dried under vacuum conditions (40° C./24 h). The fine particles A and B satisfying the requirements of the present invention are selected and extracted, and the amount thereof is measured.

Method for Measuring Volume Resistivity of Fine Particles B

The volume resistivity of the fine particles B is calculated from a current value measured using an electrometer (6430 type sub-femtoamp remote source meter manufactured by Keithley Instruments Co.). A total of 1.0 g of the fine particles B is filled in a sample holder (SH2-Z type manufactured by TOYO Corporation) of an upper and lower electrode sandwiching type, and the fine particles B are compressed by applying a torque of 2.0 N·m. The electrodes used have an upper electrode diameter of 25 mm and a lower electrode diameter of 2.5 mm. A voltage of 10.0 V is applied to the fine particles B through the sample holder, a resistance value is calculated from a current value at the time of saturation that does not include a charging current, and a volume resistivity is calculated by the following equation.

The fine particles B can be isolated from the toner by dispersing the toner in a solvent such as chloroform and then isolating the fine particles B by a specific gravity difference by centrifuging or the like. It is also possible to measure the fine particles B by themselves in case where the fine particles B by themselves can be obtained.

$$\text{Volume resistivity } (\Omega\text{m}) = \text{resistance value } (\Omega) \cdot \text{electrode area } (m^2)/\text{sample thickness } (m)$$

Method for Measuring Number Average Particle Diameter of Primary Particles of Fine Particles B The number average particle diameter of primary particles of the fine particles B is measured using a scanning electron microscope "S-4800" (trade name; manufactured by Hitachi, Ltd.). The toner to which the fine particles B have been added is observed and the major axis of 100 primary particles of the fine particles B is randomly measured in a field of view enlarged up to 50,000 times to obtain the number average particle diameter. The observation magnification is adjusted, as appropriate, depending on the size of the fine particles B.

When the fine particles B can be obtained alone, the fine particles B can be measured alone.

Method for Measuring Number Average Particle Diameter of Primary Particles of Fine Particles C The number average particle diameter of the fine particles C is measured in the same manner as in the method for measuring the number average particle diameter of primary particles of the fine particles B. In order to distinguish from the fine particles A and the fine particles B, EDS analysis is performed on each particle of the external additive, and it is determined whether or not the analyzed particles are the fine particles C.

Method for Measuring the Proportion of Area Occupied by Embedded Fine Particles B The proportion of the area occupied by the embedded fine particles B is measured using a transmission electron microscope (TEM) (JEM-2100 manufactured by JEOL Ltd.).

In the preparation of the sample, the toner to be observed is sufficiently dispersed in an epoxy resin curable at normal temperature. Thereafter, the cured product obtained by curing in an atmosphere at a temperature of 35° C. for 2 days is observed as it is or after freezing as a flaky sample obtained by using a microtome equipped with a diamond blade.

The circle-equivalent diameter of the toner is determined from the cross-sectional area in a transmission micrograph, and the toner in which the value obtained is within ±10% of the number average particle diameter of the toner particles determined by the above-described method using a Coulter counter is selected for TEM observation. The following toner cross-sectional image analysis is performed on 100 cross sections.

For image analysis, the image processing software "Image-Pro Plus 5.1J" (manufactured by Media Cybernetics) is used.

Discrimination between embedded fine particles B and non-embedded fine particles B will be described hereinbelow. Where only a part of the fine particle B is embedded in the toner particle, when the length of a portion of the fine particle B in contact with the toner particle is 50% or more of a peripheral length of the fine particle B, it is assumed that the fine particle B is embedded. When the length of a portion of the fine particle B in contact with the toner particle is less than 50%, it is assumed that the fine particle B is not embedded.

A region used for image analysis in the toner cross section will be described hereinbelow. The contour of the cross section of the toner is the outermost surface of the toner. A portion where the fine particles A or B are the outermost surface and a portion where the toner particle is the outermost surface are included in one particle of the toner. A region from the contour of the cross section of the toner to 30 nm inside toward the centroid of the cross section is defined as the surface vicinity region. When the entire fine particle B or a part thereof embedded in the toner particle is contained in the toner inner side with respect to the surface vicinity region, the area of this portion is not included in the area of the embedded fine particle B.

The proportion F of the area occupied by a part of the fine particles B embedded in the surface vicinity region, based on the total area occupied by the fine particles B present in the cross section of one particle of the toner, is calculated.

A total of 100 cross sections are observed and the arithmetic mean value thereof is used.

Method for Measuring the Proportion of Area Occupied by Embedded Fine Particles C The proportion of the area occupied by the embedded fine particles C is calculated in the same manner as in the method for measuring the proportion of the area occupied by the embedded fine particles B.

In order to distinguish the fine particles A and the fine particles B, EDS analysis is performed on each particle of the external additive, and it is determined whether the analyzed particles are the fine particles C.

Measurement of Fixing Ratio G of Fine Particles A to Toner Particle

A total of 160 g of sucrose (manufactured by Kishida Chemical) is added to 100 mL of ion-exchanged water, and dissolved in a water bath to prepare a concentrated sucrose solution. A total of 31 g of the concentrated sucrose solution and 6 mL of CONTAMINON N (a 10% by mass aqueous solution of a neutral detergent for cleaning precision measuring instruments; has a pH of 7 and includes a nonionic surfactant, an anionic surfactant and an organic builder, manufactured by Wako Pure Chemical Industries, Ltd.) are placed in a tube (capacity 50 mL) for centrifugation to prepare a dispersion liquid. A total of 1.0 g of the toner is added to the dispersion liquid, and the lumps of the toner are loosened with a spatula or the like.

The tube for centrifugation is shaken for 20 min on a shaker ("KMShaker" manufactured by Iwaki Sangyo Co., Ltd.) at a condition of 350 spin (strokes per min). After shaking, the solution is transferred to a glass tube (capacity 50 mL) for a swing rotor, and separated under conditions of 3500 rpm and 30 min in a centrifuge (H-9R; manufactured by Kokusan Co., Ltd.).

It is visually confirmed that the toner and the aqueous solution are sufficiently separated, and the toner separated in the uppermost layer is collected with a spatula or the like. An aqueous solution including the collected toner is filtered with a vacuum filter, and then dried with a dryer for 1 h or more. The dried product is deagglomerated with a spatula, and the amount of metal elements contained in the fine particle A is measured by X-ray fluorescence. The fixing ratio (%) is calculated from the ratio of the element amounts of the toner treated with the dispersion liquid and the initial toner to be measured.

The measurement of the fluorescent X-rays of each element conforms to JIS K 0119-1969, and is specifically as follows.

As a measuring device, a wavelength dispersive X-ray fluorescence spectrometer "Axios" (manufactured by PANalytical) and dedicated software "SuperQ ver. 4.0F" (manufactured by PANalytical) provided therewith for setting measurement conditions and analyzing measurement data are used. Rh is used as the anode of the X-ray tube, the measurement atmosphere is vacuum, the measurement diameter (collimator mask diameter) is 10 mm, and the measurement time is 10 sec. When a light element is measured, a proportional counter (PC) is used, and when a heavy element is measured, a scintillation counter (SC) is used.

A pellet prepared by placing about 1 g of the toner treated with the dispersion liquid or the initial toner into a dedicated aluminum ring for pressing that has a diameter of 10 mm, flattening, and molding to a thickness of about 2 mm by pressing with a tablet compression machine "BRE-32" (Maekawa Testing Machine MFG Co., Ltd.) at 20 MPa for 60 sec is used as a measurement sample.

The measurement is performed under the above conditions, the elements are identified based on the obtained X-ray peak positions, and the concentration thereof is calculated from the count rate (unit: cps) which is the number of X-ray photons per unit time.

The method for quantifying the toner will be described by taking, for example, a case where the fine particles A are zinc stearate. Fine powder of zinc stearate is added to 100 parts by mass of the toner particle to obtain 0.5 parts by mass, and sufficiently mixed using a coffee mill. Similarly, zinc stearate is mixed with the toner particles to obtain 1.0 part by mass and 2.0 parts by mass, and these mixtures are used as samples for a calibration curve.

For each sample, a pellet for a calibration curve sample is prepared as described above using the tablet compression machine, and the Kα ray net intensity of the metal element of the fatty acid metal salt is measured. A calibration curve in the form of a linear function is obtained by plotting the obtained X-ray count rate on the ordinate and the amount of fatty acid metal salt added in each calibration curve sample on the abscissa.

Next, using the pellet of the toner to be analyzed, the Kc-ray net intensity of the metal element of the fatty acid metal salt is measured. Then, the amount of the fatty acid metal salt in the toner is determined from the calibration curve. The ratio of the element amount in the toner treated with the dispersion liquid to the element amount in the initial toner calculated by the abovementioned method is determined and taken as the fixing ratio G (%).

Method for Measuring Dispersion Degree Evaluation Index of Fine Particles B

Calculation of the dispersion degree evaluation index of the fine particles B in the toner surface is performed using a scanning electron microscope "S-4800". The toner to which the fine particles B were externally added is observed in a field of view magnified 10,000 times at an accelerating voltage of 1.0 kV in the same field of view. Using the image processing software "Image-Pro Plus 5.1J" (manufactured by Media Cybernetics, Inc.), calculation is performed in the following manner from the observed image.

Binarization is performed so that only the fine particles B are extracted, the number n of the fine particles B and the barycentric coordinates of all the fine particles B are calculated, and the distance dn min between each fine particle B and the nearest fine particle B is calculated. Assuming the average value of the closest distance between the fine particles B in the image is taken as d ave, the degree of dispersion is represented by the following formula.

$$\text{Dispersion degree evaluation index} = \sqrt{\frac{\sum_{1}^{n}(dn\ \min - d\ ave)^2}{n}} \Big/ d\ ave$$

The dispersion degree is determined for 50 randomly observed toners by the above procedure, and the average value is used as the dispersion degree evaluation index. The smaller the dispersion degree evaluation index, the better the dispersibility.

Method for Measuring Melting Point of Wax and Glass Transition Temperature Tg of Toner Particle The melting point of the wax and the glass transition temperature Tg of the toner particle are measured using a differential scanning calorimeter "Q1000" (manufactured by TA Instruments) in accordance with ASTM D3418-82. The temperature correction of the device detection unit uses the melting points of indium and zinc, and the heat quantity correction uses the heat of fusion of indium.

Specifically, about 3 mg of a sample (wax, toner particles) is precisely weighed and placed in an aluminum pan, and an empty aluminum pan is used as a reference. The measurement is performed at a temperature rise rate of 10° C./min in a measuring temperature range of from 30° C. to 200° C. In the measurement, the temperature is once raised to 200° C. at a rate of 10° C./min, then lowered to 30° C. at a rate of 10° C./min, and then raised again at a rate of 10° C./min.

Physical properties are determined using the DSC curve obtained in the second temperature increase process. In this DSC curve, the temperature showing a maximum endothermic peak of the DSC curve in the temperature range of from 30° C. to 200° C. is defined as the melting point of the sample. In the DSC curve, the intersection between the line at the midpoint of the baseline before and after the change in specific heat and the DSC curve is defined as the glass transition temperature Tg.

Measurement of Average Circularity of Toner Particles

The average circularity of the toner particle is measured with a "FPIA-3000" flow particle image analyzer (Sysmex Corporation) under the measurement and analysis conditions for calibration operations.

The specific measurement methods are as follows.

About 20 mL of ion-exchange water from which solid impurities and the like have been removed is first placed in a glass container. About 0.2 mL of a dilute solution of "Contaminon N" (a 10 mass % aqueous solution of a pH 7 neutral detergent for washing precision instruments, comprising a nonionic surfactant, an anionic surfactant and an organic builder, manufactured by Wako Pure Chemical Industries, Ltd.) diluted 3-fold by mass with ion-exchange water is then added.

About 0.02 g of the measurement sample is then added and dispersed for 2 minutes with an ultrasonic disperser to obtain a dispersion for measurement. Cooling is performed as appropriate during this process so that the temperature of the dispersion is 10° C. to 40° C.

Using a tabletop ultrasonic cleaner and disperser having an oscillating frequency of 50 kHz and an electrical output of 150 W (for example, "VS-150" manufactured by Velvo-Clear), a specific amount of ion-exchange water is placed on the disperser tank, and about 2 mL of the Contaminon N is added to the tank.

A flow particle image analyzer equipped with a "LUCPLFLN" objective lens (magnification 20×, aperture 0.40) is used for measurement, with particle sheath "PSE-900A" (Sysmex Corporation) as the sheath liquid. The liquid dispersion obtained by the procedures above is introduced into the flow particle image analyzer, and 2000 toner particles are measured in HPF measurement mode, total count mode.

The average circularity of the toner particle is then determined with a binarization threshold of 85% during particle analysis, and with the analyzed particle diameters limited to equivalent circle diameters of at least 1.977 μm to less than 39.54 μm.

Prior to the start of measurement, autofocus adjustment is performed using standard latex particles (for example, Duke Scientific Corporation "RESEARCH AND TEST PARTICLES Latex Microsphere Suspensions 5100A" diluted with ion-exchange water). Autofocus adjustment is then performed again every two hours after the start of measurement.

EXAMPLES

The invention is explained in more detail below based on examples and comparative examples, but the invention is in no way limited to these. Unless otherwise specified, parts in the examples are based on mass.

Production Example of Toner Particles 1

Toner particle 1 manufacturing examples are explained here.

Preparing Resin Particle Dispersion 89.5 parts of styrene, 9.2 parts of butyl acrylate, 1.3 parts of acrylic acid and 3.2 parts of n-lauryl mercaptane were mixed and dissolved. An aqueous solution of 1.5 parts of Neogen RK (DKS Co., Ltd.) in 150 parts of ion-exchange water was added and dispersed. This was then gently stirred for 10 minutes as an aqueous solution of 0.3 parts of potassium persfulate in 10 parts of ion-exchange water was added. After nitrogen purging, emulsion polymerization was performed for 6 hours at 70° C. After completion of polymerization, the reaction solution was cooled to room temperature, and ion-exchange water was added to obtain a resin particle dispersion with a median volume-based particle diameter of 0.2 m and a solids concentration of 12.5 mass %.

Preparing Release Agent Dispersion 100 parts of a release agent (behenyl behenate, melting point 72.1° C.) and 15 parts of Neogen RK were mixed with 385 parts of ion-exchange water, and dispersed for about 1 hour with a wet type jet mill unit JN100 (Jokoh Co., Ltd.) to obtain a release agent dispersion. The solids concentration of the release agent dispersion was 20 mass %.

Preparation of Colorant Dispersion 100 parts of carbon black as a colorant "Nipex35 (Orion Engineered Carbons)" and 15 parts of Neogen RK were mixed with 885 parts of ion-exchange water, and dispersed for about 1 hour in a wet type jet mill unit JN100 to obtain a colorant dispersion.

Preparation of Toner Particles 265 parts of the resin particle dispersion, 10 parts of the release agent dispersion and 10 parts of the colorant dispersion were dispersed with a homogenizer (Ultra-Turrax T50, IKA). The temperature inside the vessel was adjusted to 30° C. under stirring, and 1 mol/L hydrochloric acid was added to adjust the pH to 5.0. This was left for 3 minutes before initiating temperature rise, and the temperature was raised to 50° C. to produce aggregate particles.

The particle diameter of the aggregate particles was measured under these conditions with a "Multisizer (R) 3 Coulter Counter" (Beckman Coulter, Inc.). Once the weight-average particle diameter reached 6.2 μm, 1 mol/L sodium hydroxide aqueous solution was added to adjust the pH to 8.0 and arrest particle growth.

The temperature was then raised to 95° C. to fuse and spheroidize the aggregate particles. Temperature lowering was initiated when the average circularity reached 0.980, and the temperature was lowered to 30° C. to obtain a toner particle dispersion 1.

Hydrochloric acid was added to adjust the pH of the resulting toner particle dispersion 1 to 1.5 or less, and the dispersion was stirred for 1 hour, left standing, and then subjected to solid-liquid separation in a pressure filter to obtain a toner cake. This was made into a slurry with ion-exchange water, re-dispersed, and subjected to solid-liquid separation in the previous filter unit. Re-slurrying and solid-liquid separation were repeated until the electrical conductivity of the filtrate was not more than 5.0 μS/cm, to ultimately obtain a solid-liquid separated toner cake.

The resulting toner cake was dried with a flash jet dryer (air dryer) (Seishin Enterprise Co., Ltd.). The drying conditions were a blowing temperature of 90° C. and a dryer outlet temperature of 40° C., with the toner cake supply speed adjusted according to the moisture content of the toner cake so that the outlet temperature did not deviate from 40° C. Fine and coarse powder was cut with a multi-division classifier using the Coanda effect, to obtain a toner particle 1. Table 1 shows various physical properties.

Production Example of Toner Particles 2

Toner particles 2 were obtained in the same manner as in the Production Example of Toner Particles 1 except that the particle growth stopping timing in the generation step of the aggregate particles in the production example of the toner particles 1 is changed. Table 1 shows various physical properties.

Production Example of Toner Particles 3

Toner particles 3 were obtained in the same manner as in the Production Example of Toner Particles 1 except that paraffin wax (melting point: 75.4° C.) was used instead of behenyl behenate (melting point: 72.1° C.) in the preparation of the release agent-dispersed solution in the Production Example of Toner Particles 1. Table 1 shows various physical properties.

TABLE 1

| | Number average particle diameter (μm) | Theoretic surface area C ($m^2/g$) | Average circularity | Tg (° C.) |
|---|---|---|---|---|
| Toner particle 1 | 5.5 | 0.99 | 0.980 | 57 |
| Toner particle 2 | 4.5 | 1.20 | 0.981 | 57 |
| Toner particle 3 | 5.5 | 1.00 | 0.978 | 58 |

Production of Fatty Acid Metal Salt Fine Particles A1

A receiving container equipped with a stirrer was prepared, and the stirrer was rotated at 350 rpm. 500 parts of an 0.5 mass % aqueous solution of sodium stearate were placed in the receiving container, and the liquid temperature was adjusted to 85° C. 525 parts of an 0.2 mass % zinc sulfate aqueous solution were then dripped into the receiving container over the course of 15 minutes. After completion of all additions, this was cured for 10 minutes at the same temperature as the reaction, and the reaction was ended.

The fatty acid metal salt slurry thus obtained was filtered and washed. The resulting washed fatty acid metal salt cake was crushed, and dried at 105° C. with a continuous instantaneous air dryer. This was then pulverized with a Nano Grinding Mill NJ-300 (Sunrex Industry Co., Ltd.) with an air flow of 6.0 $m^3$/min at a processing speed of 80 kg/h. This was re-slurried, and fine and coarse particles were removed with a wet centrifuge. This was then dried at 80° C. with a continuous instantaneous air drier to obtain a dried fatty acid metal salt fine particles A1.

The resulting fatty acid metal salt fine particles A1 had a volume-based median diameter (D50s) of 0.45 μm and a span value B of 0.92. Table 2 shows the physical properties of the fatty acid metal salt fine particles A1.

Production of Fatty Acid Metal Salt Fine Particles A2

In the Production of Fatty Acid Metal Salt Fine Particles A1, the 0.5% by mass aqueous solution of sodium stearate was replaced with a 1.0% by mass aqueous solution of sodium stearate, and the 0.2% by mass aqueous solution of zinc sulfate was replaced with 0.7% by mass aqueous solution of calcium chloride. The reaction was terminated by 5-min aging. Further, the pulverization conditions were changed to an air volume of 5.0 $m^3$/min, and after the pulverization, fine and coarse powders were removed with a wind-type classifier to obtain fatty acid metal salt fine particles A2.

The resulting fatty acid metal salt fine particles A2 had a volume-based median diameter (D50s) of 0.58 μm and a span value of 1.73. Table 2 shows the physical properties of the fatty acid metal salt fine particles A2.

Production of Fatty Acid Metal Salt Fine Particles A3

Fatty acid metal salt fine particles A3 were obtained in the same manner as in the Production of Fatty Acid Metal Salt Fine Particles A1, except that the 0.2% by mass aqueous solution of zinc sulfate was replaced with a 0.3% by mass aqueous solution of lithium chloride. The resulting fatty acid metal salt particles A3 had a volume-based median diameter (D50s) of 0.33 μm and a span value B of 0.85. Table 2 shows the physical properties of the fatty acid metal salt fine particles A3.

Production of Fatty Acid Metal Salt Fine Particles A4

In the production of the fatty acid metal salt fine particles A1, the 0.5% by mass aqueous solution of sodium stearate was replaced with a 0.5% by mass aqueous solution of sodium laurate, the conditions of pulverization were changed to an air flow of 10.0 $m^3$/min, and the pulverization step was performed three times. The resulting fatty acid metal salt particles A4 had a volume-based median diameter (D50s) of 0.18 μm and a span value B of 1.34. Table 2 shows the physical properties of the fatty acid metal salt fine particles A4.

Production of Fatty Acid Metal Salt Fine Particles A5

In the production of the fatty acid metal salt fine particles A1, the 0.5% by mass aqueous solution of sodium stearate was replaced with a 0.05% by mass aqueous solution of sodium stearate, and the 0.2% by mass aqueous solution of zinc sulfate was replaced with a 0.02% by mass aqueous solution of zinc sulfate. The conditions of pulverization were changed to an air flow of 10.0 $m^3$/min, and the pulverization step was performed three times. After that, coarse particles were removed by passing through a mesh, without performing a classification step, to obtain fatty acid metal salt fine particles A5.

The resulting fatty acid metal salt fine particles A5 had a volume-based median diameter (D50s) of 0.12 μm and a span value B of 1.05. Table 2 shows the physical properties of the fatty acid metal salt fine particles A5.

Production of Fatty Acid Metal Salt Fine Particles A6

Commercially available zinc stearate (SZ2000, manufactured by Sakai Chemical Industry Co., Ltd.) was used as fatty acid metal salt fine particles A6. The volume-based median diameter (D50s) was 5.30 μm, and the span value was 1.84. Table 2 shows the physical properties of the fatty acid metal salt fine particles A6.

TABLE 2

| | Length of C chain | Metal | Median diameter (μm) | Span value |
|---|---|---|---|---|
| Fine particles A1 | 18 | Zn | 0.45 | 0.92 |
| Fine particles A2 | 18 | Ca | 0.58 | 1.73 |
| Fine particles A3 | 18 | Li | 0.33 | 0.85 |
| Fine particles A4 | 12 | Zn | 0.18 | 1.34 |
| Fine particles A5 | 18 | Zn | 0.12 | 1.05 |
| Fine particles A6 | 18 | Zn | 5.30 | 1.84 |

Production Example of Fine Particles B1

Ilmenite ore including 50% by mass of $TiO_2$ equivalent was dried at 150° C. for 3 h, and then dissolved by adding sulfuric acid to obtain an aqueous solution of $TiOSO_4$. After concentrating the obtained aqueous solution, 10 parts of titania sol having rutile crystals were added as seeds, and then hydrolysis was performed at 170° C. to obtain a slurry of $TiO(OH)_2$ including impurities. This slurry was repeatedly washed at pH 5 to 6, and sulfuric acid, $FeSO_4$ and impurities were sufficiently removed to obtain a slurry of high-purity metatitanic acid [$TiO(OH)_2$].

After this slurry was filtered, 0.5 parts of lithium carbonate ($L_2CO_3$) was added, and the mixture was calcined at 250° C. for 3 h. Then, the deagglomeration treatment by a jet mill was repeated to obtain titanium oxide fine particles having rutile-type crystals. A total of 5 parts of isobutyltrimethoxysilane as a surface treatment agent was dropped, mixed and reacted with 100 parts of the titanium oxide fine particles while dispersing the obtained titanium oxide fine particles in ethanol and stirring. After drying, the mixture was heat-treated at 170° C. for 3 h, and the deagglomeration treatment was repeatedly performed with a jet mill until the titanium oxide aggregates disappeared, thereby obtaining fine particles B1 as fine titanium oxide particles. Table 3 shows the physical properties.

Production Example of Fine Particles B2

Fine particles B2, which are titanium oxide fine particles, were obtained in the same manner as the fine particles B1, except that in the Production Example of Fine Particles B1, the calcination temperature was 240° C. and the amount of isobutyltrimethoxysilane as the surface treatment agent was changed to 15 parts. Table 3 shows the physical properties.

Production Example of Fine Particles B3

Fine particles B3, which are titanium oxide fine particles, were obtained in the same manner as the fine particles B1 except that the calcination temperature in the Production Example of Fine Particles B1 was changed to 260° C. Table 3 shows the physical properties.

Production Example of Fine Particles B4

After metatitanic acid obtained by the sulfuric acid method was subjected to deironization bleaching treatment, an aqueous solution of sodium hydroxide was added to adjust the pH to 9.0, desulfurization treatment was performed, and then neutralization was performed with hydrochloric acid to pH 5.8, followed by filtration and water washing. Water was added to the washed cake to form a slurry of 1.85 mol/L as $TiO_2$, and then hydrochloric acid was added to adjust the pH to 1.0, followed by deflocculation.

The metatitanic acid subjected to desulfurization and deflocculation was collected in an amount of 1.88 mol as $TiO_2$ and charged into a 3 L reaction vessel. A total of 2.16 mol of an aqueous solution of strontium chloride was added to the deflocculated metatitanic acid slurry so that Sr/Ti (molar ratio) was 1.15, and the $TiO_2$ concentration was adjusted to 1.039 mol/L.

Next, heating was performed to 90° C. while stirring and mixing, and 440 mL of a 10 mol/L aqueous solution of sodium hydroxide was added over 45 min. Thereafter, stirring was continued at 95° C. for 1 h to complete the reaction. The reaction slurry was cooled to 50° C., hydrochloric acid was added until the pH reached 5.0, and stirring was continued for 1 h. The obtained precipitate was washed by decantation.

The slurry including the precipitate was adjusted to 40° C., and the pH was adjusted to 2.5 by adding hydrochloric acid. Then, 4.0% by mass of n-octyltriethoxysilane with respect to the solid fraction was added, and the mixture was kept under stirring for 10 h. The cake obtained by adjusting the pH to 6.5 by adding a 5 mol/L sodium hydroxide solution and continuing stirring for 1 h, followed by filtration and washing, was dried in the air at 120° C. for 8 h to obtain fine particles B4 as strontium titanate fine particles. Table 3 shows the physical properties.

Production Example of Fine Particles B5

Oxygen was supplied to a combustor at 50 $Nm^3$/h and argon gas was supplied at 2 $Nm^3$/h to form a zone for ignition of aluminum powder. Next, aluminum powder (average particle diameter: about 45 μm, supply amount: 20 kg/h) was supplied to the reaction furnace through a combustor together with nitrogen gas (supply amount: 3.5 $Nm^3$/h) from an aluminum powder supply device.

Alumina particles were obtained by oxidizing the aluminum powder in the reaction furnace. The alumina particles obtained after passing through the reaction furnace were classified to remove fine and coarse powder, thereby obtaining alumina fine particles B5. Table 3 shows the physical properties.

Production Example of Fine Particle B6

Fine particles B6, which are strontium titanate fine particles, were obtained in the same manner as the fine particles B4, except that 6.0% by mass of n-octyltriethoxysilane with respect to the solid fraction was added. Table 3 shows the physical properties.

TABLE 3

| | Material | Volume resistivity (Ωm) | Number average particle diameter of primary particles (nm) |
|---|---|---|---|
| Fine particles B1 | Titanium oxide | $3.0 \times 10^5$ | 20 |
| Fine particles B2 | Titanium oxide | $7.8 \times 10^7$ | 15 |
| Fine particles B3 | Titanium oxide | $5.5 \times 10^5$ | 55 |
| Fine particles B4 | Strontium titanate | $3.4 \times 10^7$ | 30 |
| Fine particles B5 | Alumina | $2.6 \times 10^9$ | 38 |
| Fine particles B6 | Strontium titanate | $9.5 \times 10^7$ | 35 |

Fine Particles C1 to C2

The fine particles C shown in Table 4 were used.

TABLE 4

| Fine particles C | Material | Number average particle diameter of primary particles (nm) |
|---|---|---|
| Fine particles C1 | Silica | 10 |
| Fine particles C2 | Silica | 55 |

Production Example of Toner 1

As the first step, the toner particles 1 and the fine particles B1 were mixed using an FM mixer (model FM10C manufactured by Nippon Coke Industry Co., Ltd.).

With the water temperature in the jacket of the FM mixer kept stabilized at 50° C.±1° C., 100 parts of toner particles 1 and 1.00 part of fine particles B1 were loaded into the mixer. The mixing was started at a peripheral speed of the rotating blades of 38 m/sec and was performed for 7 min while controlling the water temperature and the flow rate in the jacket so that the temperature in the tank was stabilized at 50° C.±1° C., thereby obtaining a mixture of the toner particles 1 and the fine particles B1.

Subsequently, as a second step, the fine particles A1 and the fine particles C1 were added to the mixture of the toner particles 1 and the fine particles B1 using the FM mixer (model FM10C, manufactured by Nippon Coke Industry Co., Ltd.). With the water temperature in the jacket of the FM mixer stabilized at 25° C.±1° C., 0.20 parts of the fine particles A1 and 0.80 parts of the fine particles C1 were added to 100 parts of the toner particles 1. The mixing was started at a peripheral speed of the rotating blades of 20 m/sec and was performed for 5 min while controlling the water temperature and the flow rate in the jacket so that the temperature in the tank was stabilized at 25° C.±1° C. After mixing, the mixture was sieved through a mesh with an aperture of 75 μm, thereby obtaining a toner 1.

Table 5-1 and 5-2 show the production conditions of the toner 1, and Table 6 shows various physical properties of the toner 1.

TABLE 5-1

| | | First step | | | | | | | | |
|---|---|---|---|---|---|---|---|---|---|---|
| | Toner | Fine particles A | | Fine particles B | | Fine particles C | | | | Temperature |
| Toner No. | particle No. | No. | added parts | No. | added parts | No. | added parts | Mixing device | Mixing conditions | in tank (° C.) |
| 1 | 1 | — | — | 1 | 1.00 | — | — | FM mixer | 38 m/sec × 7 min | 50 |
| 2 | 1 | — | — | 4 | 1.00 | — | — | FM mixer | 38 m/sec × 7 min | 50 |
| 3 | 1 | — | — | 2 | 1.00 | — | — | FM mixer | 38 m/sec × 7 min | 50 |
| 4 | 1 | — | — | 6 | 1.00 | — | — | FM mixer | 38 m/sec × 7 min | 50 |
| 5 | 1 | — | — | 1 | 1.00 | — | — | FM mixer | 38 m/sec × 7 min | 50 |
| 6 | 1 | — | — | 1 | 1.00 | — | — | FM mixer | 38 m/sec × 7 min | 50 |
| 7 | 1 | — | — | 4 | 1.00 | — | — | FM mixer | 38 m/sec × 7 min | 50 |
| 8 | 1 | — | — | 1 | 1.00 | — | — | FM mixer | 38 m/sec × 7 min | 50 |
| 9 | 2 | — | — | 1 | 1.00 | — | — | FM mixer | 38 m/sec × 7 min | 50 |
| 10 | 2 | — | — | 4 | 1.00 | — | — | FM mixer | 38 m/sec × 7 min | 50 |
| 11 | 1 | — | — | 1 | 1.00 | — | — | FM mixer | 38 m/sec × 7 min | 50 |
| 12 | 1 | — | — | 1 | 1.00 | — | — | FM mixer | 38 m/sec × 7 min | 50 |
| 13 | 1 | — | — | 1 | 1.00 | 1 | 0.80 | FM mixer | 38 m/sec × 7 min | 50 |
| 14 | 3 | — | — | 1 | 1.00 | — | — | FM mixer | 38 m/sec × 7 min | 50 |
| 15 | 1 | — | — | 1 | 1.00 | — | — | FM mixer | 38 m/sec × 7 min | 50 |
| 16 | 1 | — | — | 1 | 1.00 | — | — | FM mixer | 38 m/sec × 7 min | 50 |
| 17 | 1 | — | — | 1 | 1.00 | — | — | FM mixer | 38 m/sec × 7 min | 50 |
| 18 | 1 | — | — | 1 | 1.00 | — | — | FM mixer | 38 m/sec × 5 min | 50 |
| 19 | 1 | — | — | 4 | 1.00 | — | — | FM mixer | 38 m/sec × 5 min | 50 |
| 20 | 1 | — | — | 1 | 1.00 | — | — | FM mixer | 38 m/sec × 7 min | 50 |
| 21 | 1 | — | — | 1 | 1.00 | — | — | FM mixer | 38 m/sec × 7 min | 45 |

TABLE 5-1-continued

| | | First step | | | | | | | | |
|---|---|---|---|---|---|---|---|---|---|---|
| | Toner | Fine particles A | | Fine particles B | | Fine particles C | | | | Temperature |
| Toner No. | particle No. | No. | added parts | No. | added parts | No. | added parts | Mixing device | Mixing conditions | in tank (° C.) |
| 22 | 1 | — | — | 1 | 1.00 | — | — | FM mixer | 38 m/sec × 7 min | 45 |
| 23 | 1 | — | — | 4 | 1.00 | — | — | FM mixer | 38 m/sec × 7 min | 45 |
| 24 | 1 | — | — | 4 | 1.00 | — | — | FM mixer | 38 m/sec × 7 min | 45 |
| 25 | 1 | — | — | 1 | 1.00 | — | — | FM mixer | 38 m/sec × 10 min | 50 |
| 26 | 1 | — | — | 1 | 0.10 | — | — | FM mixer | 38 m/sec × 7 min | 50 |
| 27 | 1 | — | — | 1 | 3.00 | — | — | FM mixer | 38 m/sec × 7 min | 50 |
| 28 | 1 | | | 3 | 1.00 | | | FM mixer | 38 m/sec × 7 min | 50 |
| 29 | 1 | — | — | 3 | 1.00 | — | — | FM mixer | 38 m/sec × 2 min | 50 |
| C. 1 | 1 | — | — | 1 | 1.00 | — | — | FM mixer | 38 m/sec × 7 min | 50 |
| C. 2 | 1 | — | — | 1 | 1.00 | — | — | FM mixer | 38 m/sec × 7 min | 50 |
| C. 3 | 1 | — | — | 1 | 1.00 | — | — | FM mixer | 38 m/sec × 7 min | 50 |
| C. 4 | 1 | — | — | 1 | 1.00 | — | — | FM mixer | 28 m/sec × 5 min | 25 |
| C. 5 | 1 | — | — | 4 | 1.00 | — | — | FM mixer | 28 m/sec × 5 min | 25 |
| C. 6 | 1 | — | — | 5 | 1.00 | — | — | FM mixer | 38 m/sec × 7 min | 50 |
| C. 7 | 1 | — | — | 1 | 0.08 | — | — | FM mixer | 38 m/sec × 7 min | 50 |
| C. 8 | 1 | — | — | 1 | 3.20 | — | — | FM mixer | 38 m/sec × 7 min | 50 |
| C. 9 | 1 | — | — | 2 | 1.00 | 1 | 0.80 | FM mixer | 40 m/sec × 10 min | 25 |
| C. 10 | 1 | — | — | 2 | 1.00 | 1 | 0.80 | FM mixer | 40 m/sec × 10 min | 25 |
| C. 11 | 1 | — | — | 1 | 0.50 | 2 | 0.80 | FM mixer | 40 m/sec × 10 min | 25 |
| C. 12 | 1 | 1 | 0.4 | 4 | 0.60 | 2 | 0.80 | FM mixer | 40 m/sec × 15 min | 25 |

In the table "C." denotes comparative.

TABLE 5-2

| | Second step | | | | | | | | | Third step | | | | |
|---|---|---|---|---|---|---|---|---|---|---|---|---|---|---|
| | Fine particles A | | Fine particles B | | Fine particles C | | | | T. in | Fine particles A | | | | T. in |
| Toner No. | No. | added parts | No. | added parts | No. | added parts | Mixing device | Mixing conditions | tank (° C.) | No. | added parts | Mixing device | Mixing conditions | tank (° C.) |
| 1 | 1 | 0.20 | — | — | 1 | 0.80 | FM mixer | 20 m/sec × 5 min | 25 | — | — | — | — | — |
| 2 | 1 | 0.20 | — | — | 1 | 0.80 | FM mixer | 20 m/sec × 5 min | 25 | — | — | — | — | — |
| 3 | 1 | 0.20 | — | — | 1 | 0.80 | FM mixer | 20 m/sec × 5 min | 25 | — | — | — | — | — |
| 4 | 1 | 0.20 | — | — | 1 | 0.80 | FM mixer | 20 m/sec × 5 min | 25 | — | — | — | — | — |
| 5 | 1 | 0.20 | — | — | 1 | 0.80 | FM mixer | 15 m/sec × 5 min | 25 | — | — | — | — | — |
| 6 | 1 | 0.30 | — | — | 1 | 0.80 | FM mixer | 25 m/sec × 5 min | 25 | — | — | — | — | — |
| 7 | 1 | 0.30 | — | — | 1 | 0.80 | FM mixer | 25 m/sec × 5 min | 25 | — | — | — | — | — |
| 8 | 1 | 0.10 | — | — | 1 | 0.80 | FM mixer | 20 m/sec × 3 min | 25 | — | — | — | — | — |
| 9 | 1 | 1.80 | — | — | 1 | 0.80 | FM mixer | 20 m/sec × 5 min | 25 | — | — | — | — | — |
| 10 | 1 | 1.80 | — | — | 1 | 0.80 | FM mixer | 20 m/sec × 5 min | 25 | — | — | — | — | — |
| 11 | 1 | 0.03 | — | — | 1 | 0.80 | FM mixer | 20 m/sec × 5 min | 25 | — | — | — | — | — |
| 12 | 1 | 0.20 | — | — | 2 | 1.00 | FM mixer | 20 m/sec × 5 min | 25 | — | — | — | — | — |
| 13 | 1 | 0.20 | — | — | — | — | FM mixer | 20 m/sec × 5 min | 25 | — | — | — | — | — |
| 14 | 1 | 0.20 | — | — | 1 | 0.80 | FM mixer | 20 m/sec × 5 min | 25 | — | — | — | — | — |
| 15 | 2 | 0.20 | — | — | 1 | 0.80 | FM mixer | 20 m/sec × 5 min | 25 | — | — | — | — | — |
| 16 | 3 | 0.20 | — | — | 1 | 0.80 | FM mixer | 20 m/sec × 5 min | 25 | — | — | — | — | — |
| 17 | 4 | 0.20 | — | — | 1 | 0.80 | FM mixer | 20 m/sec × 5 min | 25 | — | — | — | — | — |
| 18 | 5 | 0.20 | — | — | 1 | 0.80 | FM mixer | 20 m/sec × 5 min | 25 | — | — | — | — | — |
| 19 | 1 | 0.20 | — | — | 1 | 0.80 | FM mixer | 20 m/sec × 5 min | 25 | — | — | — | — | — |
| 20 | 6 | 0.50 | — | — | 1 | 0.80 | FM mixer | 20 m/sec × 5 min | 25 | — | — | — | — | — |
| 21 | 1 | 0.20 | — | — | 1 | 0.80 | FM mixer | 25 m/sec × 5 min | 25 | — | — | — | — | — |
| 22 | 1 | 0.20 | — | — | 1 | 0.80 | FM mixer | 28 m/sec × 5 min | 25 | — | — | — | — | — |
| 23 | 1 | 0.20 | — | — | 1 | 0.80 | FM mixer | 25 m/sec × 5 min | 25 | — | — | — | — | — |
| 24 | 1 | 0.20 | — | — | 1 | 0.80 | FM mixer | 28 m/sec × 5 min | 25 | — | — | — | — | — |
| 25 | 1 | 0.20 | — | — | 1 | 0.80 | FM mixer | 20 m/sec × 3 min | 25 | — | — | — | — | — |
| 26 | 1 | 0.20 | — | — | 1 | 0.80 | FM mixer | 20 m/sec × 5 min | 25 | — | — | — | — | — |
| 27 | 1 | 0.20 | — | — | 1 | 0.80 | FM mixer | 20 m/sec × 5 min | 25 | — | — | — | — | — |
| 28 | 1 | 0.20 | — | — | 1 | 0.80 | FM mixer | 20 m/sec × 5 min | 25 | — | — | — | — | — |
| 29 | 1 | 0.20 | — | — | 1 | 0.80 | FM mixer | 20 m/sec × 5 min | 25 | — | — | — | — | — |
| C. 1 | 1 | 0.20 | — | — | 1 | 0.80 | FM mixer | 35 m/sec × 5 min | 25 | — | — | — | — | — |
| C. 2 | 1 | 1.80 | — | — | 1 | 0.80 | FM mixer | 20 m/sec × 5 min | 25 | — | — | — | — | — |
| C. 3 | 1 | 0.02 | — | — | 1 | 0.80 | FM mixer | 20 m/sec × 5 min | 25 | — | — | — | — | — |
| C. 4 | 1 | 0.20 | — | — | 1 | 0.80 | FM mixer | 20 m/sec × 5 min | 25 | — | — | — | — | — |
| C. 5 | 1 | 0.20 | — | — | 1 | 0.80 | FM mixer | 20 m/sec × 5 min | 25 | — | — | — | — | — |
| C. 6 | 1 | 0.20 | — | — | 1 | 0.80 | FM mixer | 20 m/sec × 5 min | 25 | — | — | — | — | — |
| C. 7 | 1 | 0.20 | — | — | 1 | 0.80 | FM mixer | 20 m/sec × 5 min | 25 | — | — | — | — | — |

TABLE 5-2-continued

| | Second step | | | | | | | | | Third step | | | | |
|---|---|---|---|---|---|---|---|---|---|---|---|---|---|---|
| | Fine particles A | | Fine particles B | | Fine particles C | | | | T. in | Fine particles A | | | | T. in |
| Toner No. | No. | added parts | No. | added parts | No. | added parts | Mixing device | Mixing conditions | tank (° C.) | No. | added parts | Mixing device | Mixing conditions | tank (° C.) |
| C. 8 | 1 | 0.20 | — | — | 1 | 0.80 | FM mixer | 20 m/sec × 5 min | 25 | — | — | — | — | — |
| C. 9 | 1 | 0.50 | — | — | — | — | FM mixer | 20 m/sec × 5 min | 25 | — | — | — | — | — |
| C. 10 | 1 | 0.20 | — | — | — | — | FM mixer | 40 m/sec × 5 min | 25 | — | — | — | — | — |
| C. 11 | 6 | 0.2 | 1 | 0.50 | — | — | FM mixer | 40 m/sec × 10 min | 25 | 6 | 0.40 | FM mixer | 40 m/sec × 10 min | 25 |
| C. 12 | 1 | 0 | — | — | — | — | — | — | — | — | — | — | — | — |

Production Examples of Toners 21 to 29 and Comparative Toners 1 to 12

Toners 2 to 29 and Comparative Toners 1 to 12 were obtained in the same manner as in the Production Example of Toner 1, except that the toner particles, number of parts of the fine particles A to C added in the first step, the second step and the third step, and the mixing conditions shown in Tables 5-1 and 5-2 were changed. Table 6 shows the physical properties.

TABLE 6

| Toner No. | Amount D (mass %) | Cov. ratio E % | D/C | E/(D/C) | Amount of fine particles B (mass %) | D index | Embedded area F of fine particles B (%) | Embedded area of fine particles C (%) | FG % | (100-G)/(100-F) |
|---|---|---|---|---|---|---|---|---|---|---|
| 1 | 0.20 | 5.0 | 0.20 | 24.8 | 1.00 | 0.3 | 70 | 20 | 2.1 | 3.3 |
| 2 | 0.20 | 6.0 | 0.20 | 29.7 | 1.00 | 0.3 | 69 | 22 | 3.0 | 3.1 |
| 3 | 0.20 | 4.0 | 0.20 | 19.8 | 1.00 | 0.3 | 76 | 26 | 2.5 | 4.1 |
| 4 | 0.20 | 4.0 | 0.20 | 19.8 | 1.00 | 0.3 | 68 | 24 | 3.0 | 3.0 |
| 5 | 0.20 | 0.7 | 0.20 | 3.5 | 1.00 | 0.3 | 70 | 18 | 1.0 | 3.3 |
| 6 | 0.30 | 14.5 | 0.30 | 47.9 | 1.00 | 0.3 | 70 | 24 | 9.0 | 3.0 |
| 7 | 0.30 | 15.0 | 0.30 | 49.5 | 1.00 | 0.3 | 66 | 26 | 10.0 | 2.6 |
| 8 | 0.10 | 2.0 | 0.10 | 19.8 | 1.00 | 0.3 | 70 | 22 | 2.8 | 3.2 |
| 9 | 1.80 | 38.0 | 1.50 | 25.3 | 1.00 | 0.3 | 70 | 22 | 3.0 | 3.2 |
| 10 | 1.80 | 37.0 | 1.50 | 24.7 | 1.00 | 0.3 | 63 | 22 | 2.5 | 2.6 |
| 11 | 0.03 | 0.5 | 0.03 | 16.5 | 1.00 | 0.3 | 70 | 22 | 2.8 | 3.2 |
| 12 | 0.20 | 5.0 | 0.20 | 24.8 | 1.00 | 0.3 | 70 | 24 | 3.1 | 3.2 |
| 13 | 0.20 | 6.0 | 0.20 | 29.7 | 1.00 | 0.3 | 70 | 56 | 2.8 | 3.2 |
| 14 | 0.20 | 8.0 | 0.20 | 40.0 | 1.00 | 0.3 | 60 | 23 | 2.9 | 2.4 |
| 15 | 0.20 | 6.0 | 0.20 | 29.7 | 1.00 | 0.3 | 70 | 21 | 1.8 | 3.3 |
| 16 | 0.20 | 5.5 | 0.20 | 27.2 | 1.00 | 0.3 | 70 | 21 | 1.6 | 3.3 |
| 17 | 0.20 | 8.0 | 0.20 | 39.6 | 1.00 | 0.3 | 70 | 24 | 5.2 | 3.2 |
| 18 | 0.20 | 9.0 | 0.20 | 44.6 | 1.00 | 0.2 | 60 | 25 | 9.0 | 2.3 |
| 19 | 0.20 | 9.0 | 0.20 | 44.6 | 1.00 | 0.2 | 60 | 24 | 9.0 | 2.3 |
| 20 | 0.50 | 10.0 | 0.51 | 19.8 | 1.00 | 0.3 | 70 | 24 | 0.8 | 3.3 |
| 21 | 0.20 | 9.0 | 0.20 | 44.6 | 1.00 | 0.2 | 53 | 30 | 10.0 | 1.9 |
| 22 | 0.20 | 9.5 | 0.20 | 47.0 | 1.00 | 0.2 | 53 | 35 | 12.0 | 1.9 |
| 23 | 0.20 | 8.5 | 0.20 | 42.1 | 1.00 | 0.2 | 51 | 32 | 8.0 | 1.9 |
| 24 | 0.20 | 9.0 | 0.20 | 44.6 | 1.00 | 0.2 | 50 | 32 | 9.0 | 1.8 |
| 25 | 0.20 | 2.0 | 0.20 | 9.9 | 1.00 | 0.3 | 88 | 36 | 1.0 | 8.3 |
| 26 | 0.20 | 5.0 | 0.20 | 24.8 | 0.10 | 0.3 | 85 | 24 | 2.6 | 6.5 |
| 27 | 0.20 | 4.0 | 0.20 | 19.8 | 3.00 | 0.3 | 67 | 26 | 2.2 | 3.0 |
| 28 | 0.20 | 6.0 | 0.20 | 29.7 | 1.00 | 0.3 | 66 | 16 | 2.1 | 2.9 |
| 29 | 0.20 | 5.5 | 0.20 | 27.2 | 1.00 | 0.6 | 72 | 20 | 2.8 | 3.5 |
| C. 1 | 0.20 | 11.0 | 0.20 | 54.5 | 1.00 | 0.3 | 70 | 40 | 15.0 | 2.8 |
| C. 2 | 1.80 | 50.0 | 1.82 | 27.5 | 1.00 | 0.3 | 67 | 26 | 10.0 | 2.7 |
| C. 3 | 0.02 | 1.0 | 0.02 | 49.5 | 1.00 | 0.3 | 70 | 26 | 10.0 | 3.0 |
| C. 4 | 0.20 | 4.0 | 0.20 | 19.8 | 1.00 | 0.4 | 33 | 26 | 2.5 | 1.5 |
| C. 5 | 0.20 | 6.0 | 0.20 | 29.7 | 1.00 | 0.4 | 27 | 26 | 2.5 | 1.3 |
| C. 6 | 0.20 | 4.5 | 0.20 | 22.3 | 1.00 | 0.3 | 70 | 20 | 2.5 | 3.3 |
| C. 7 | 0.20 | 6.0 | 0.20 | 29.7 | 0.08 | 0.5 | 76 | 20 | 2.5 | 4.1 |
| C. 8 | 0.20 | 4.5 | 0.20 | 22.3 | 3.20 | 0.1 | 57 | 20 | 2.5 | 2.3 |
| C. 9 | 0.50 | 8.0 | 0.51 | 15.8 | 1.00 | 0.4 | 40 | 35 | 2.5 | 1.6 |
| C. 10 | 0.20 | 15.0 | 0.20 | 74.3 | 1.00 | 0.4 | 40 | 35 | 2.5 | 1.6 |
| C. 11 | 0.20 | 18.0 | 0.20 | 89.1 | 0.50 | 0.4 | 43 | 40 | 10.0 | 1.6 |
| C. 12 | 0.40 | 20.0 | 0.40 | 49.5 | 0.60 | 0.5 | 38 | 35 | 20.0 | 1.3 |

In the table, "C." denotes comparative, "Amount D" denotes "Amount D of fine particles A (mass %)", "Cov. ratio E" denotes "Coverage ratio E of fine particles A (%)", "D index" denotes "Dispersion degree index of fine particles B", and "FG" denotes "Fixing ratio G of fine particles A (%)".

Production Example of Electrophotographic Photosensitive Member

An aluminum cylinder (JIS A 3003, aluminum alloy) having a diameter of 24 mm and a length of 257.5 mm was used as a support (conductive support).

Formation of Conductive Layer

Next, 214 parts of titanium oxide ($TiO_2$) particles (average primary particle diameter 230 nm) coated with oxygen-deficient tin oxide ($SnO_2$) as metal oxide particles, 132 parts of a phenol resin (monomer/oligomer of phenol resin) (trade name: PLYOFEN J-325, manufactured by Dainippon Ink and Chemicals, Inc., resin solid fraction: 60% by mass) as a binder material, and 98 parts of 1-methoxy-2-propanol as a solvent were placed in a sand mill using 450 parts of glass beads having a diameter of 0.8 mm, and subjected to a dispersion treatment under the conditions of a rotation speed: 2000 rpm, a dispersion treatment time: 4.5 h, and a cooling water set temperature: 18° C. to obtain a dispersion liquid. Glass beads were removed from the dispersion liquid with a mesh (aperture: 150 μm).

Silicone resin particles (trade name: TOSPEARL 120, manufactured by Momentive Performance Materials Co., Ltd., average particle diameter 2 μm) as a surface roughening material were added to the dispersion liquid to obtain 10% by mass thereof with respect to the total mass of the metal oxide particles and the binder material in the dispersion liquid after the removal of glass beads, and silicone oil (trade name: SH28PA, manufactured by Dow Corning Toray Co., Ltd.) as a leveling agent was added to the dispersion liquid to obtain 0.01% by mass thereof with respect to the total mass of the metal oxide particles and the binder material in the dispersion liquid.

Next, a mixed solvent of methanol and 1-methoxy-2-propanol (mass ratio 1:1) was added to the dispersion liquid so that the total mass of the metal oxide particles, the binder material, and the surface roughening material (that is, the mass of the solid fraction) in the dispersion liquid was 67% by mass with respect to the mass of the dispersion liquid, and stirring was performed to prepare a conductive layer coating liquid. This conductive layer coating liquid was dip-coated onto a support and heated at 150° C. for 30 min to form a conductive layer having a thickness of 30.0 μm.

Formation of Undercoat Layer

A total of 4 parts of electron transport material (E), 5.5 parts of blocked isocyanate (trade name: DURANATE SBN-70D, manufactured by Asahi Kasei Chemicals Corporation), 0.3 parts of polyvinyl butyral resin (S-LEC KS-5Z, manufactured by Sekisui Chemical Co., Ltd.), and 0.05 parts of zinc (II) hexanoate (manufactured by Mitsui Chemicals, Inc.) as a catalyst were dissolved in a mixed solvent of 50 parts of tetrahydrofuran and 50 parts of 1-methoxy-2-propanol to prepare an undercoat layer coating solution. This undercoat layer coating liquid was dip-coated onto the conductive layer, and heated at 170° C. for 30 min to form an undercoat layer having a thickness of 0.7 μm.

(E)

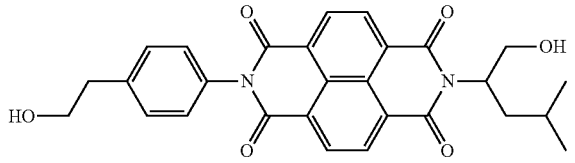

Formation of Charge Generation Layer

Next, 10 parts of crystalline hydroxygallium phthalocyanine having peaks at 7.5° and 28.4° in a chart obtained from $CuK_\alpha$ characteristic X-ray diffraction, and 5 parts of a polyvinyl butyral resin (trade name: S-LEC BX-1, manufactured by Sekisui Chemical Co., Ltd.) were added to 200 parts of cyclohexanone, and dispersed for 6 h in a sand mill using glass beads having a diameter of 0.9 mm. To this, 150 parts of cyclohexanone and 350 parts of ethyl acetate were further added for dilution to obtain a coating solution for a charge generation layer.

The obtained coating solution was dip-coated onto the undercoat layer and dried at 95° C. for 10 min to form a charge generation layer having a thickness of 0.20 μm. The X-ray diffraction measurement was performed under the following conditions.

Powder X-ray Diffraction Measurement

Measurement device: X-ray diffractometer RINT-TTRII, manufactured by Rigaku

Denki Co., Ltd.

X-ray tube: Cu

Tube voltage: 50 KV

Tube current: 300 mA

Scan method: 2θ/θ scan

Scan speed: 4.0/min

Sampling interval: 0.02°

Start angle (2θ): 5.0°

Stop angle (2θ): 40.0°

Attachment: standard sample holder

Filter: not used

Incident monochrome: used

Counter monochromator: not used

Divergent slit: open

Divergent vertical restriction slit: 10.00 mm

Scattering slit: open

Light reception slit: open

Plate monochromator: used

Counter: scintillation counter

Formation of Charge Transport Layer

Next, 6 parts of a compound represented by a formula (C-1) hereinbelow (charge transport substance (hole transporting compound)), 3 parts of a compound represented by a formula (C-2) hereinbelow (charge transport substance (hole transporting compound)), 1 part of a compound represented by a formula (C-3) hereinbelow (charge transport substance (hole transporting compound)), 10 parts of a polycarbonate (trade name: Iupilon Z400, manufactured by Mitsubishi Engineering-Plastics Corporation), and 0.02 part of a polycarbonate resin having a copolymerized unit of (C-4) and (C-5) (x/y=9/1: Mw=20000) were dissolved in a mixed solvent including 25 parts of o-xylene, 25 parts of methyl benzoate, and 25 parts of dimethoxymethane to prepare a coating solution for a charge transport layer. This coating solution for a charge transport layer was dip-coated onto the charge generation layer to form a coating film, and the coating film was dried at 120° C. for 30 min to form a charge transport layer having a thickness of 12 μm.

C-1

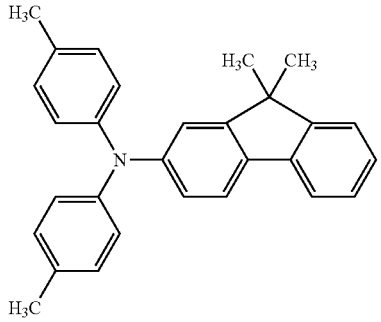

C-2

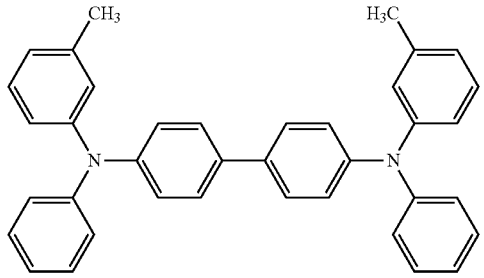

C-3

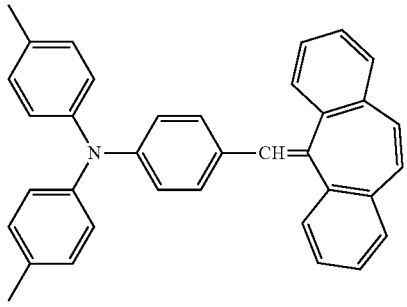

C-4

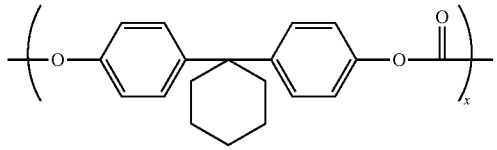

C-5

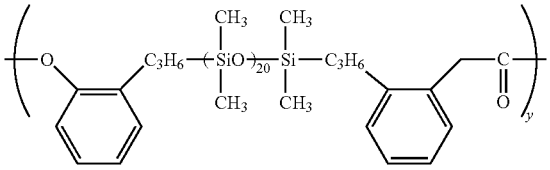

Formation of Protective Layer

Next, 10 parts of the compound represented by a formula (O-1) hereinbelow and 10 parts of the compound represented by a formula (O-2) hereinbelow were mixed and stirred with 50 parts of 1-propanol and 25 parts of 1,1,2,2,3,3,4-heptafluorocyclopentane (trade name: ZEOROLA H, manufactured by Nippon Zeon Co., Ltd.).

Thereafter, this solution was filtered through a polyflon filter (trade name: PF-020, manufactured by Advantec Toyo Kaisha, Ltd.) to prepare a coating solution for a protective layer.

(0-1)

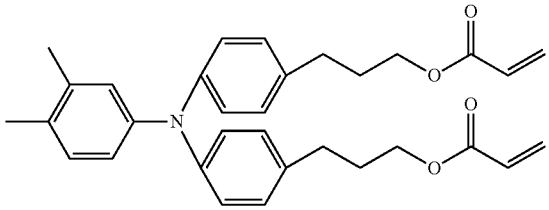

(0-2)

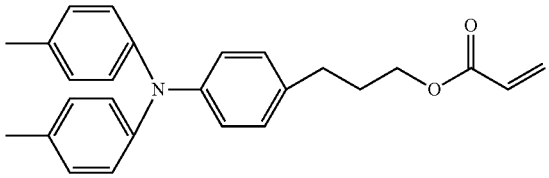

This protective layer coating solution was dip-coated onto the charge transport layer to form a coating film, and the obtained coating film was dried at 50° C. for 6 min. Thereafter, the coating film was irradiated with an electron beam for 5.0 sec in a nitrogen atmosphere while rotating the support (irradiation target) at a speed of 200 rpm under the conditions of an acceleration voltage of 70 kV and a beam current of 5.0 mA. The absorbed dose of the electron beam measured at this time was 15 kGy.

Thereafter, the temperature of the coating film was raised from 25° C. to 117° C. over 30 sec in a nitrogen atmosphere, to heat the coating film. The oxygen concentration from electron beam irradiation to the subsequent heat treatment was 15 ppm or less. Next, the coating film was naturally cooled in the atmosphere until the temperature of the coating film reached 25° C., followed by heating for 30 min under the condition that the temperature of the coating film reached 105° C., thereby forming a protective layer having a thickness of 3 μm. Thus, an electrophotographic photosensitive member having a protective layer was produced.

Thus, a cylindrical (drum-shaped) electrophotographic photosensitive member 1 having the support, the undercoat layer, the charge generation layer, the charge transport layer, and the protective layer in this order was produces.

Example 1

A modified version of a commercially available laser beam printer LBP9950Ci manufactured by Canon Inc. was used. The modification included setting the rotation speed of the developing roller to be twice as high as the peripheral speed of the drum by changing the gear and software of an evaluation device main body, and changing the process speed to 330 mm/sec. The toner contained in the LBP9950Ci toner cartridge was extracted, the inside thereof was cleaned with an air blow, and then 180 g of the toner to be evaluated was loaded.

The electrophotographic photosensitive member was removed, and the electrophotographic photosensitive member 1 was newly set. As a result of using a hard photosensitive member having a hardened surface protective layer, nitrogen oxides were less likely to be scraped off and a severe condition for image smearing was realized. Then, the toner cartridge was allowed to stand for 5 days in a low-temperature and low-humidity environment of L/L (10° C./15% RH) and a high-temperature and high-humidity environment H/H (30° C./80% RH).

The toner cartridge that was allowed to stand for 5 days in the low-temperature and low-humidity L/L environment was attached to the cyan station of LBP9950Ci, up to 20,000 prints of an image with a print percentage of 1.0% were printed out, and the retransfer (after durability), development streaks, and image density uniformity (L/L) of the initial and 20,000-th output were evaluated.

Evaluation of Retransfer

At the initial stage and after the 20,000-th print, a cartridge containing no toner was set in the black station, and a cartridge filled with the toner to be evaluated was set in the cyan station. Then, the developing voltage was adjusted so that the toner laid-on level was 0.6 mg/cm$^2$, and an all-solid image was outputted.

Next, the toner retransferred to the photosensitive member of the cartridge of the black station was removed by taping with a Mylar tape. Thereafter, the tape and a tape that was not taped were affixed to LETTER size XEROX 4200 paper (manufactured by XEROX Corporation, 75 g/m$^2$). The reflectance (%) of each tape was measured with "REFLECTOMETER MODEL TC-6DS" (manufactured by Tokyo Denshoku Co., Ltd.).

Then, the evaluation was performed using a numerical value (retransfer) (%) obtained by subtracting the reflectance (%) of the tape that was taped from the reflectance (%) of the tape that was not taped. The smaller the value of retransfer, the more retransfer is suppressed. C and above were determined to be satisfactory.

A: retransfer is less than 2.0%.

B: retransfer is 2.0% or more and less than 5.0%.

C: retransfer is 5.0% or more and less than 10.0%.

D: retransfer is 10.0% or more.

Evaluation of Development Streaks

After printing 20,000 prints, a halftone image was printed out. The printed halftone image was evaluated according to the following criteria. B and above were determined to be satisfactory.

A: the number of streaks on the halftone image is 0 or 1.

B: the number of streaks on the halftone image is 2 to 4.

C: the number of streaks on the halftone image is 5 or more.

Evaluation of Image Density Uniformity

The evaluation of image density uniformity was performed in a low-temperature and low-humidity environment (temperature: 15.0° C., relative humidity: 10%), which is assumed to be more severe with respect to retransfer because the effect of retransfer is significant. FOX RIVER BOND paper (110 g/m$^2$), which is rough paper, was used for the evaluation.

In the evaluation of the image density, an image having a top margin of 5 mm and left and right margins of 5 mm and a solid black patch image of 5 mm×5 mm in a total of 9 locations: 3 locations spaced by 30 mm at 3 placed (left, right, and center) was outputted after printing the first and 20,000-th prints of the long-term durability test.

The image densities of nine solid black patch image portions of the image were measured, and the difference between the maximum value and the minimum value of all the densities was obtained. The image density was measured with a Macbeth densitometer (manufactured by MACBETH) using an SPI filter. The smaller the numerical difference between the maximum value and the minimum value, the better the image density uniformity. B and above were determined to be satisfactory.

A: the difference between the maximum value and the minimum value of the image density is 0.05 or less.

B: the difference between the maximum value and the minimum value of the image density is from 0.06 to 0.10.

C: the difference between the maximum value and the minimum value of the image density is 0.11 or more.

Evaluation of Image Smearing

The toner cartridge allowed to stand for 5 days in a high-temperature and high-humidity environment was attached to the cyan station of LBP9500C, and an A4 image of a 1-dot 2-space horizontal ruled line was intermittently printed 20,000 times in a durability mode.

After that, the cartridge was allowed to stand for 72 h in an H/H environment, and an A4 image of a 1-dot 2-space horizontal ruled line was outputted. The ruled line width reduction (%) of the image after standing for 72 h with respect to that before standing for 72 h was evaluated based on the following criteria. The thickness of the ruled line of an image is an average value of a plurality of thicknesses of the ruled line in one image. The ruled line width reduction (%) is calculated by the following formula. C and above were determined to be satisfactory.

Ruled line width reduction (%)={[(thickness of ruled line of image before the image was allowed to stand)−(thickness of ruled line of image after the image was allowed to stand)]/(thickness of ruled line of image before the image was allowed to stand)}×100

A: ruled line width reduction is less than 10%.

B: ruled line width reduction is 10% or more and less than 25%.

C: ruled line width reduction is 25% or more and less than 40%.

D: ruled line width reduction is 40% or more.

TABLE 7

| Toner | High-temperature high-humidity environment Image smearing | | Low-temperature low-humidity environment Retransfer | | | | Density uniformity | | | | Development streak |
|---|---|---|---|---|---|---|---|---|---|---|---|
| No. | 20,000-th print | | First print | | 20,000-th print | | First print | | 20,000-th print | | 20,000-th print |
| 1 | A | 4 | A | 0.0 | A | 0.4 | A | 0.01 | A | 0.03 | A |
| 2 | A | 4 | A | 0.0 | A | 0.5 | A | 0.02 | A | 0.05 | A |
| 3 | A | 6 | A | 0.5 | B | 4.9 | A | 0.02 | A | 0.04 | A |
| 4 | A | 6 | A | 0.5 | B | 4.0 | A | 0.02 | A | 0.04 | A |
| 5 | A | 4 | A | 0.0 | A | 0.3 | A | 0.03 | A | 0.05 | A |
| 6 | A | 5 | A | 0.3 | B | 3.0 | A | 0.02 | A | 0.03 | A |
| 7 | A | 5 | A | 0.3 | B | 2.8 | A | 0.02 | A | 0.04 | A |
| 8 | B | 21 | A | 0.0 | A | 0.3 | A | 0.02 | A | 0.04 | A |

TABLE 7-continued

| Toner | High-temperature high-humidity environment Image smearing | | Low-temperature low-humidity environment Retransfer | | | | Density uniformity | | | | Development streak |
|---|---|---|---|---|---|---|---|---|---|---|---|
| No. | 20,000-th print | | First print | | 20,000-th print | | First print | | 20,000-th print | | 20,000-th print |
| 9 | A | 2 | A | 0.4 | C | 5.5 | A | 0.02 | A | 0.05 | A |
| 10 | A | 2 | A | 0.4 | C | 5.1 | A | 0.02 | A | 0.05 | A |
| 11 | C | 32 | A | 0.1 | A | 0.6 | A | 0.02 | A | 0.05 | A |
| 12 | A | 6 | A | 0.5 | B | 3.0 | A | 0.03 | B | 0.10 | A |
| 13 | A | 8 | A | 0.8 | B | 3.5 | A | 0.05 | B | 0.10 | A |
| 14 | B | 14 | A | 0.5 | B | 4.0 | A | 0.03 | A | 0.05 | A |
| 15 | A | 6 | A | 0.7 | B | 4.2 | A | 0.02 | A | 0.04 | A |
| 16 | A | 7 | A | 0.7 | B | 4.5 | A | 0.03 | A | 0.04 | A |
| 17 | B | 22 | A | 0.5 | C | 6.0 | A | 0.02 | A | 0.05 | A |
| 18 | B | 24 | A | 0.6 | C | 7.0 | A | 0.02 | A | 0.04 | A |
| 19 | B | 23 | A | 0.6 | C | 7.0 | A | 0.02 | A | 0.04 | A |
| 20 | A | 8 | A | 0.5 | B | 2.5 | A | 0.02 | A | 0.05 | B |
| 21 | B | 15 | A | 0.5 | C | 7.0 | A | 0.03 | A | 0.05 | B |
| 22 | B | 18 | A | 0.5 | C | 7.5 | A | 0.02 | A | 0.04 | B |
| 23 | B | 15 | A | 0.5 | C | 7.0 | A | 0.02 | A | 0.05 | B |
| 24 | B | 18 | A | 0.5 | C | 7.5 | A | 0.02 | A | 0.05 | B |
| 25 | B | 20 | A | 0.5 | C | 6.5 | A | 0.02 | A | 0.04 | B |
| 26 | A | 7 | A | 0.9 | C | 8.0 | A | 0.03 | B | 0.06 | A |
| 27 | A | 6 | A | 0.3 | B | 2.5 | A | 0.02 | A | 0.04 | A |
| 28 | A | 5 | A | 0.7 | C | 8.0 | A | 0.03 | A | 0.05 | A |
| 29 | A | 9 | A | 0.7 | C | 9.0 | A | 0.02 | A | 0.04 | A |
| C. 1 | C | 30 | A | 1.0 | D | 11.0 | A | 0.03 | B | 0.09 | A |
| C. 2 | A | 7 | B | 2.0 | D | 11.0 | A | 0.03 | B | 0.07 | B |
| C. 3 | D | 43 | A | 0.0 | A | 0.7 | A | 0.03 | A | 0.04 | A |
| C. 4 | B | 21 | B | 3.0 | D | 12.0 | A | 0.03 | B | 0.08 | C |
| C. 5 | B | 22 | B | 4.0 | D | 13.0 | A | 0.03 | B | 0.07 | C |
| C. 6 | B | 23 | B | 4.0 | D | 18.0 | A | 0.04 | B | 0.08 | A |
| C. 7 | B | 10 | B | 4.0 | D | 19.0 | A | 0.05 | C | 0.13 | A |
| C. 8 | B | 10 | C | 5.0 | D | 25.0 | A | 0.03 | A | 0.04 | A |
| C. 9 | B | 24 | B | 3.0 | D | 16.0 | A | 0.03 | B | 0.07 | C |
| C. 10 | D | 42 | B | 3.0 | D | 17.0 | A | 0.03 | B | 0.08 | C |
| C. 11 | D | 41 | B | 2.0 | D | 18.0 | A | 0.04 | B | 0.08 | C |
| C. 12 | C | 38 | B | 3.0 | D | 19.0 | A | 0.05 | C | 0.11 | C |

In the table, "C." denotes comparative.

Examples 2 to 29, Comparative Examples 1 to 12

Evaluation was performed in the same manner as in Example 1. Table 7 shows the evaluation results.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-123914, filed Jul. 2, 2019, which is hereby incorporated by reference herein in its entirety.

What is claimed is:

1. A toner, comprising:

a toner particle comprising a binder resin;

fine particles A comprising a fatty acid metal salt; and fine particles B having a volume resistivity of 5.0 x 10 to 1.0 x $10^8$ Ωm and are included in an amount of 0.10 to 3.00 parts by mass based on 100 parts by mass of the toner particle, wherein fine particles A and fine particles B are present on a surface of the toner particle, $0.03 \leq D/C \leq 1.50$ and $E/(D/C) \leq 50.0$ when C ($m^2/g$) is an average theoretical surface area obtained from a number average particle diameter, particle size distribution and true density of the toner particle measured by a Coulter counter D (parts by mass) is an amount of the fine particles A with respect to 100 parts by mass of the toner particle, and E (%) is a coverage ratio of a surface of the toner particle by the fine particles A, and in an observation of a cross-section of the toner by a transmission electron microscope fine particles B comprise fine particles B' of which (i) a contact length between each of the fine particles B', (ii) each of the fine particles B' presents in a region from a contour of a cross section of one particle of the toner to 30 nm inside toward a centroid of the cross section, and (iii) F is 50% or more, where F is a proportion of an area occupied by the fine particles B' relative to a total area occupied by the fine particles B in the cross section of one particle of the toner.

2. The toner according to claim 1, wherein $2.0 \leq (100-G)/(100-F) \leq 8.0$ where G (%) is a fixing ratio of the fine particles A to the toner particle.

3. The toner according to claim 1, wherein the fine particles B have a dispersion degree evaluation index on a surface of the toner of 0.4 or less.

4. The toner according to claim 1, wherein the toner further comprises silica fine particles C that are present on the surface of the toner particle, and in the observation of the cross-section of the toner by a transmission electron microscope fine particles C comprise fine particles C' of which (i) a contact length between each of the fine particles C' and the toner particles is 50% or more of a peripheral length of each of the fine particles C', (ii) each of the fine particles C' presents in a region from a contour of a cross section of one particle of the toner to 30 nm inside toward a centroid of the cross section, and (iii) F2 is 40% by area or less, where F2 is a proportion of an area occupied by the fine particles C' relative to a total area occupied by the fine particles C in the cross section of one particle of the toner.

5. The toner according to claim 1, wherein fine particles A have a median diameter of 0.15 to 3.00 μm on a volume basis.

6. The toner according to claim 1, wherein fine particles A are fine particle of a fatty acid metal salt of a divalent or higher polyvalent metal and (ii) a fatty acid having 8 to 28 carbon atoms.

7. The toner according to claim 6, wherein the divalent or higher polyvalent metal comprises zinc.

8. The toner according to claim 1, wherein fine particles B comprise primary particles with a number average particle diameter of 5 to 50 nm.

9. The toner according to claim 1, wherein the toner particle comprises an ester wax having a melting point of 60 to 90° C.

10. The toner according to claim 1, further comprising silica fine particles C that are present on the surface of the toner particle with primary particles having a number average particle diameter of 5 to 50 nm.

11. The toner according to claim 1, wherein fine particles B are at least one member selected from the group consisting of titanium oxide fine particles and strontium titanate fine particles.

* * * * *